US009156637B2

(12) United States Patent
Asada et al.

(10) Patent No.: US 9,156,637 B2
(45) Date of Patent: Oct. 13, 2015

(54) TRAY UNIT AND IMAGE RECORDING DEVICE

(75) Inventors: Tetsuo Asada, Kuwana (JP); Satoru Nakakita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 467 days.

(21) Appl. No.: 13/242,214

(22) Filed: Sep. 23, 2011

(65) Prior Publication Data

US 2012/0081488 A1 Apr. 5, 2012

(30) Foreign Application Priority Data

Sep. 30, 2010 (JP) ..... 2010-223029

(51) Int. Cl.

| | |
|---|---|
| ***B41J 2/01*** | (2006.01) |
| ***B65H 3/06*** | (2006.01) |
| ***B41J 17/26*** | (2006.01) |
| ***B65H 1/26*** | (2006.01) |

(52) U.S. Cl.

CPC ..... *B65H 3/0684* (2013.01); *B41J 17/26* (2013.01); *B65H 1/266* (2013.01); *B65H 2402/46* (2013.01); *B65H 2405/115* (2013.01); *B65H 2405/11164* (2013.01); *B65H 2405/324* (2013.01); *B65H 2405/332* (2013.01)

(58) Field of Classification Search

USPC ..... 347/104, 101, 108; 271/9.08, 9.07, 271/9.11, 162, 164

See application file for complete search history.

(56) References Cited

U.S. PATENT DOCUMENTS

| | | | | |
|---|---|---|---|---|
| 3,989,236 | A | 11/1976 | Komori et al. | |
| 4,056,835 | A * | 11/1977 | Whitney et al. | 360/251 |
| 4,131,274 | A * | 12/1978 | Sue | 271/9.11 |
| 4,135,805 | A * | 1/1979 | Taylor et al. | 399/379 |
| 4,645,192 | A * | 2/1987 | Watanabe | 271/9.09 |
| 4,928,129 | A | 5/1990 | Honda | |
| 5,357,385 | A * | 10/1994 | Shimizu et al. | 360/96.51 |

(Continued)

FOREIGN PATENT DOCUMENTS

| | | | |
|---|---|---|---|
| CN | 101445191 A | | 6/2009 |
| JP | 02225228 A | * | 9/1990 |

(Continued)

OTHER PUBLICATIONS

Machine translation for Asada (JP Pat 2010159162A).*

(Continued)

*Primary Examiner* — Julian Huffman
*Assistant Examiner* — Leonard S Liang
(74) *Attorney, Agent, or Firm* — Baker Botts L.L.P.

(57) ABSTRACT

A tray unit includes a first tray, a second tray, and a cover. The first tray includes a first holding surface for holding thereon a first sheet. The second tray includes a second holding surface for holding thereon a second sheet. The second tray is configured to slide above and along the first holding surface between a first second-tray position and a second second-tray position, and is configured to pivot between the second second-tray position and a third second-tray position in which the second tray stands upward with respect to the first holding surface. The cover is configured to cover from above at least a part of the second tray when the second tray is in the second second-tray position, and is configured to pivot between a first cover position in which the cover extends along the first holding surface and a second cover position in which the cover stands upward with respect to the first holding surface.

28 Claims, 15 Drawing Sheets

(56) References Cited

U.S. PATENT DOCUMENTS

| | | | | |
|---|---|---|---|---|
| 5,647,585 | A | 7/1997 | Cheong | |
| 6,659,444 | B2 | 12/2003 | Kawarama | |
| 7,403,739 | B2 | 7/2008 | Hwang | |
| 7,497,565 | B2 * | 3/2009 | Kinoshita et al. | 347/101 |
| 7,547,011 | B2 | 6/2009 | Kurata et al. | |
| 7,584,950 | B2 | 9/2009 | Asada et al. | |
| 7,600,745 | B2 | 10/2009 | Asada | |
| 7,628,392 | B2 | 12/2009 | Shiohara et al. | |
| 7,654,515 | B2 | 2/2010 | Koga | |
| 7,677,548 | B2 | 3/2010 | Chino | |
| 7,681,875 | B2 | 3/2010 | Asada et al. | |
| 7,690,640 | B2 | 4/2010 | Koga et al. | |
| 7,694,951 | B2 * | 4/2010 | Shiohara | 271/9.08 |
| 7,694,952 | B2 | 4/2010 | Sosnowski et al. | |
| 7,731,179 | B2 * | 6/2010 | Izuchi et al. | 271/145 |
| 7,748,692 | B2 | 7/2010 | Shiohara | |
| 7,850,170 | B2 * | 12/2010 | Matsue et al. | 271/294 |
| 7,862,037 | B2 * | 1/2011 | Kunioka | 271/171 |
| 7,878,500 | B2 | 2/2011 | Wakakusa | |
| 7,883,284 | B2 * | 2/2011 | Asada et al. | 400/624 |
| 8,020,849 | B2 * | 9/2011 | Izuchi et al. | 271/9.11 |
| 2005/0052518 | A1 * | 3/2005 | Kagami | 347/104 |
| 2005/0225025 | A1 | 10/2005 | Chikumoto | |
| 2006/0017794 | A1 * | 1/2006 | Kinoshita et al. | 347/104 |
| 2006/0113723 | A1 * | 6/2006 | Ito et al. | 271/162 |
| 2006/0262355 | A1 | 11/2006 | Kurata et al. | |
| 2007/0013760 | A1 * | 1/2007 | Takahashi | 347/104 |
| 2007/0075476 | A1 | 4/2007 | Shiohara | |
| 2007/0182803 | A1 | 8/2007 | Asada et al. | |
| 2007/0200285 | A1 * | 8/2007 | Shiohara | 271/162 |
| 2007/0201921 | A1 * | 8/2007 | Asada et al. | 399/393 |
| 2007/0201923 | A1 | 8/2007 | Asada et al. | |
| 2008/0023023 | A1 * | 1/2008 | Boye et al. | 132/294 |
| 2008/0237977 | A1 * | 10/2008 | Izuchi et al. | 271/264 |
| 2009/0001652 | A1 | 1/2009 | Asada | |
| 2009/0140484 | A1 | 6/2009 | Asada | |
| 2009/0206539 | A1 | 8/2009 | Takeuchi et al. | |
| 2010/0164169 | A1 | 7/2010 | Wakakusa | |
| 2011/0241288 | A1 | 10/2011 | Asada et al. | |
| 2012/0080833 | A1 | 4/2012 | Asada et al. | |
| 2012/0081489 | A1 | 4/2012 | Asada et al. | |

FOREIGN PATENT DOCUMENTS

| | | | |
|---|---|---|---|
| JP | H06-008138 | Y2 | 3/1994 |
| JP | H08-12096 | A | 1/1996 |
| JP | 2006-347767 | A | 12/2006 |
| JP | 2007-230777 | A | 9/2007 |
| JP | 2009-020257 | A | 1/2009 |
| JP | 2009-107846 | A | 5/2009 |
| JP | 2010-037095 | A | 2/2010 |
| JP | 2010-159162 | A | 7/2010 |

OTHER PUBLICATIONS

United States Patent and Trademark Office, Office Action for U.S. Appl. No. 12/894,030 (counterpart to above-captioned patent application), mailed Feb. 16, 2012.

United States Patent and Trademark Office, Non Final Office Action for U.S. Appl. No. 13/841,947 (related to above-captioned patent application), mailed Jul. 15, 2013.

United States Patent and Trademark Office, Office Action for U.S. Appl. No. 12/894,030 (co-pending U.S. patent application), mailed Aug. 1, 2012.

United States Patent and Trademark Office, Office Action for U.S. Appl. No. 13/242,395 (co-pending U.S. patent application), mailed Sep. 11, 2012.

Japan Patent Office, Notice of Reasons for Rejection for Japanese Patent Application No. 2010-223029 (related to above-captioned patent application), mailed Jan. 21, 2014.

Japan Patent Office, Notice of Reasons for Rejection for Japanese Patent Application No. 2010-223032 (related to above-captioned patent application), mailed Feb. 4, 2014.

Japan Patent Office, Notice of Reasons for Rejection for Japanese Patent Application No. 2010-223116 (related to above-captioned patent application), mailed Feb. 4, 2014.

United States Patent and Trademark Office, Final Rejection for U.S. Appl. No. 13/841,947 (related to above-captioned patent application), mailed Jan. 27, 2014.

State Intellectual Property Office of the People's Republic of China, Notification of First Office Action for Chinese Patent Application No. 201110302111.4 (counterpart to above-captioned patent application), mailed Dec. 27, 2013.

* cited by examiner

TRAY UNIT AND IMAGE RECORDING DEVICE

CROSS REFERENCE TO RELATED APPLICATION

The present application claims priority from Japanese Patent Application Publication No. JP-2010-223029, which was filed on Sep. 30, 2010, the disclosure of which is incorporated herein by reference in its entirety.

BACKGROUND OF THE INVENTION

1. Field of the Invention

The present invention relates to a tray unit for storing recording media, e.g., sheets, and relates to an image recording device configured to convey a recording medium stored in a tray unit and to record an image on the recording medium.

2. Description of Related Art

A known image recording device comprises a tray unit comprising a main tray and a second tray each configured to hold thereon recording media. For example, A4 and B5 size recording sheets are placed on the main tray, and postcards are placed on the second tray. The second tray is disposed above the main tray and is configured to slide above the main tray between a position allowing a feed roller to contact the second tray and a position separated from the feed roller. The feed roller selectively feeds the sheets from the main tray and the second tray depending on the position of the second tray.

SUMMARY OF THE INVENTION

It may be beneficial to enhance the usability of a plurality of trays for use in an image recording device.

According to an embodiment of the invention, a tray unit comprises a first tray comprising a first holding surface for holding thereon a first sheet, a second tray comprising a second holding surface for holding thereon a second sheet, and a cover. The second tray is configured to slide above and along the first holding surface between a first second-tray position and a second second-tray position, and is configured to pivot between the second second-tray position and a third second-tray position in which the second tray stands upward with respect to the first holding surface. The cover is configured to cover from above at least a part of the second tray when the second tray is in the second second-tray position, and is configured to pivot between a first cover position in which the cover extends along the first holding surface and a second cover position in which the cover stands upward with respect to the first holding surface.

According to another embodiment of the invention, an image recording device comprises a first tray comprising a first holding surface for holding thereon a first sheet, a second tray comprising a second holding surface for holding thereon a second sheet, a cover, a feeder, a recording unit, and a discharging unit. The second tray is configured to slide above and along the first holding surface between a first second-tray position and a second second-tray position, and is configured to pivot between the second second-tray position and a third second-tray position in which the second tray stands upward with respect to the first holding surface. The cover is configured to cover from above at least a part of the second tray when the second tray is in the second position, and is configured to pivot between a first cover position in which the cover extends along the first holding surface and a second cover position in which the cover stands upward with respect to the first holding surface. The feeder is configured to feed the first sheet when the second tray is in the second second-tray position and to feed the second sheet when the second tray is in the first second-tray position. The recording unit is configured to record an image on the sheet fed by the feeder. The discharging unit is disposed above the cover and is configured to discharge the sheet after the recording unit records the image on the sheet.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

DETAILED DESCRIPTION OF EMBODIMENTS

Embodiments of the invention and their features and technical advantages may be understood by referring to FIGS. 1-15, like numerals being used for like corresponding parts in the various drawings.

Figure 1:
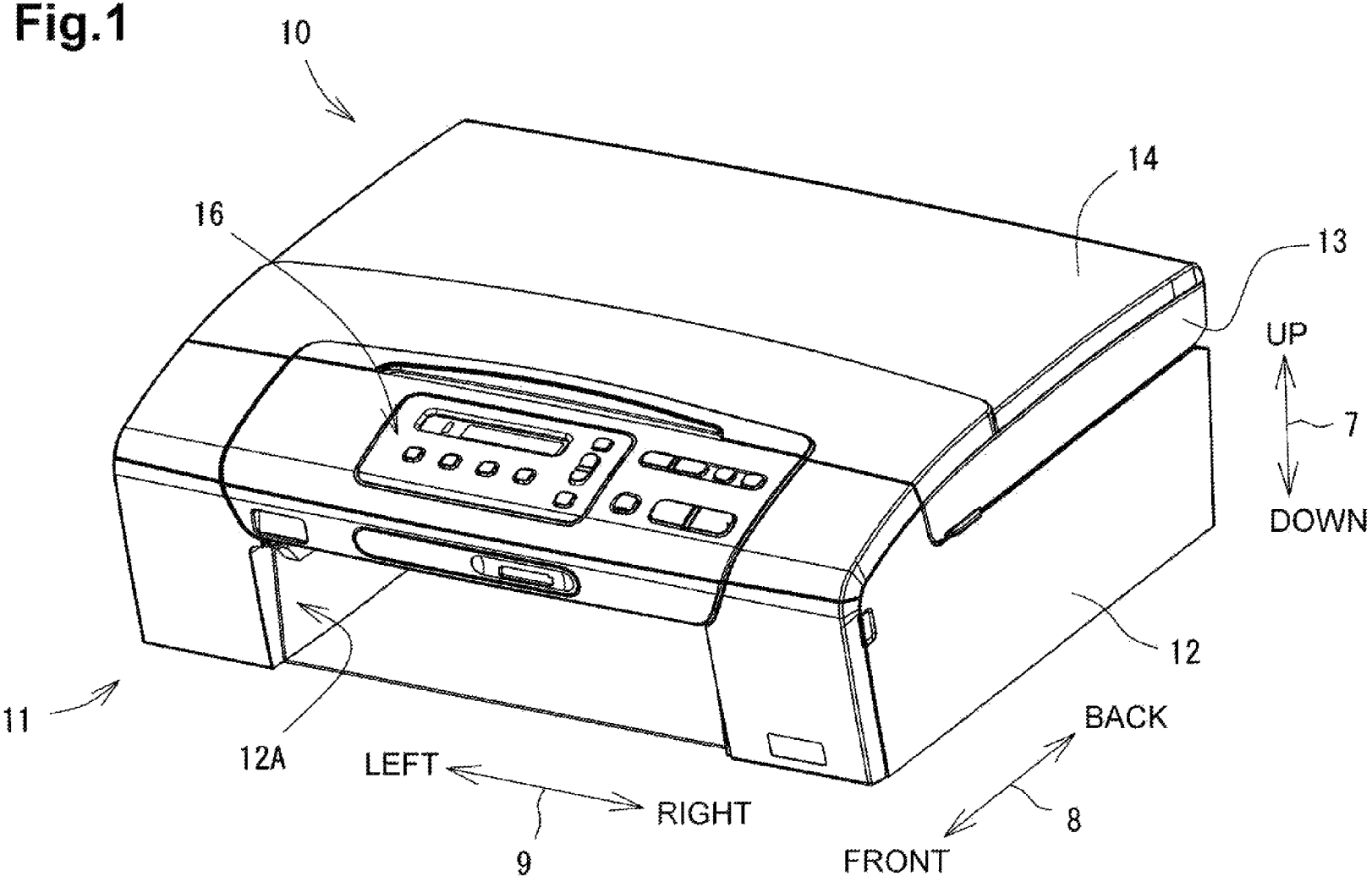
FIG. 1 is a perspective view of a main unit of an image recording device according to an embodiment of the invention.

An embodiment of the present invention will be described with reference to the drawings. In the present embodiment, an image recording device 10 comprises a main unit 11 shown in FIG. 1 and a tray unit 50 shown in FIG. 4 that is mounted into the main unit 11. As shown in FIG. 1, the main unit 11 of the image recording device 10 has a substantially rectangular parallelepiped external shape. In the following description, the height direction of the main unit 11 of the image recording device 10 is defined as an up-down direction 7, the depth direction thereof is defined as a front-back direction 8, and the width direction thereof is defined as a left-right direction 9. The tray unit 50 will be described as being mounted into the main unit 11 of the image recording device 10.

A general structure of the main unit 11 of the image recording device 10 will be described. The main unit 11 comprises a printer housing 12, a scanner housing 13 mounted on the top surface of the printer housing 12, and a document cover 14 mounted on the top surface of the scanner housing 13. The image recording device 10 is a multifunction device having a printing function, a scanning function, and a coping function.

An opening 12A through which the tray unit 50 (see FIG. 6) is inserted or extracted is formed at a lower front of the printer housing 12. The printer housing 12 comprises guiderails (not shown) that support the tray unit 50 such that the tray unit 50 is slidable in the front-back direction 8. The tray unit 50 may be supported by the printer housing 12 such that the tray unit 50 is detachable from the printer housing 12, or such that the tray unit 50 is slidable over the sliding range. A printer 15 (see FIG. 2), which will be described below, is housed in an upper area of the printer housing 12. The printer 15 records images on recording media, e.g., sheets 54. The sheets 54 are, for example, recording sheets, glossy sheets, or postcards.

The scanner housing 13 supports the document cover 14 such that the document cover 14 is openable and closable. A document sheet (not shown) can be placed on the scanner housing 13, and be retained by being sandwiched between the scanner housing 13 and the document cover 14. An image on the retained document sheet is scanned by a flatbed scanner that is housed in the scanner housing 13, and is captured as image data. The scanner and the printer 15 are controlled by a control circuit (not shown). The control circuit receives information from a plurality of input buttons 16 shown in FIG. 1 or an external device, such as a personal computer, and controls the operations of the scanner and the printer 15 on the basis of the received information. Thus, an image capturing operation and an image recording operation are performed.

Figure 2:
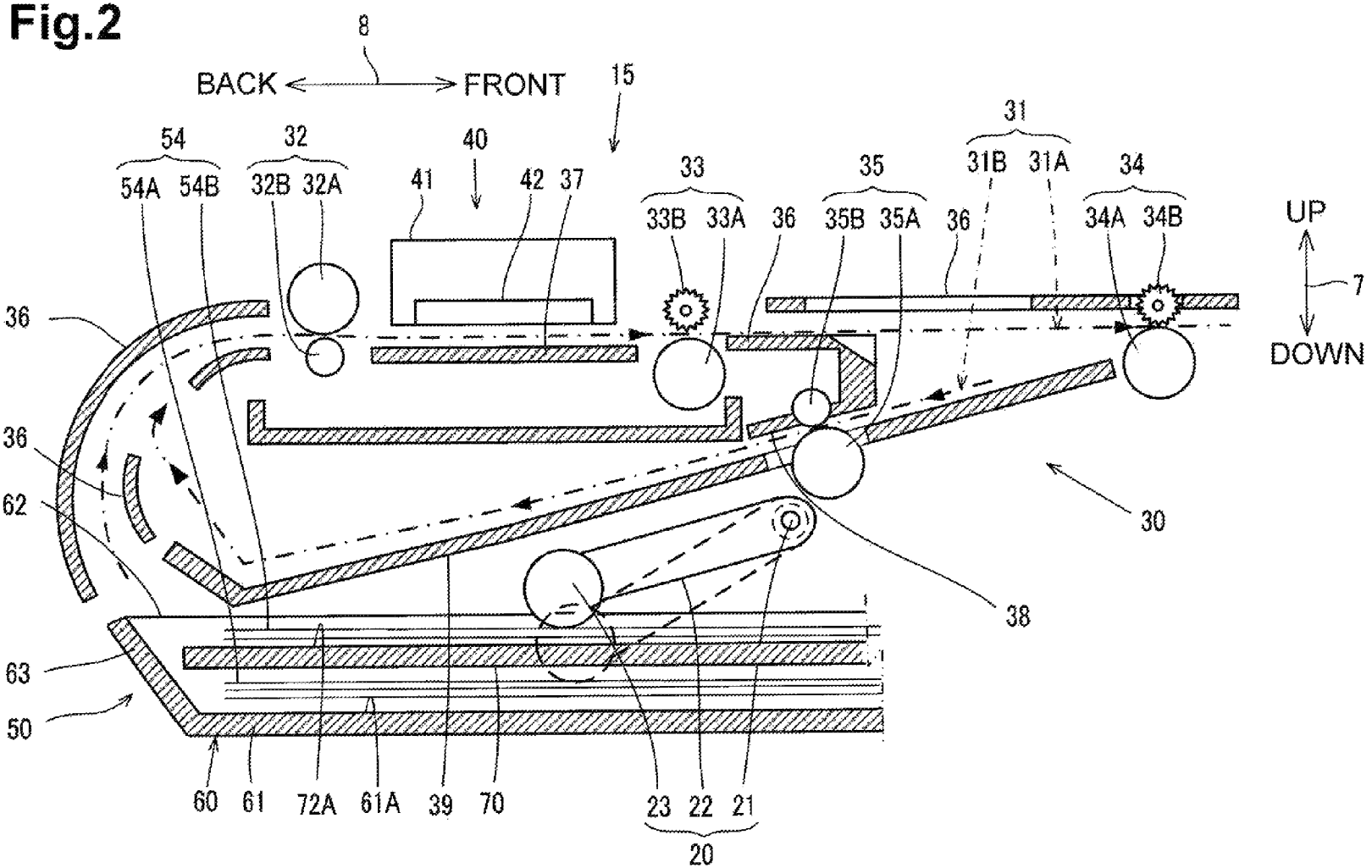
FIG. 2 is a schematic cross-sectional view of a printer of the image recording device.

As shown in FIG. 2, the printer 15 comprises a feeder 20 that feeds the sheets 54 stored in the tray unit 50 from the tray unit 50; a sheet conveyor 30 that conveys the sheets 54 fed by the feeder 20; a recording unit 40 that records images on the sheets 54 conveyed by the sheet conveyor 30; and a drive unit (not shown) that drives the recording unit 40, the sheet conveyor 30, and the scanner. The drive unit comprises a plurality of motors and a driving force transmitting mechanism that transmits the driving force of the motors to the sheet conveyor 30, the scanner, and other components. The motors are controlled by the above-described control circuit.

The feeder 20 comprises a shaft 21 that is rotatably supported by, for example, a frame fixed to the printer housing 12; an arm 22 supported by the shaft 21; and left and right feed rollers 23 supported by the arm 22.

The arm 22 is pivotably supported, at one end thereof, by the shaft 21. The other end of the arm 22 moves vertically as the arm 22 pivots about the shaft 21. Thus, the feed rollers 23 are vertically movable. When the tray unit 50 is mounted into the printer housing 12 (see FIG. 1), the arm 22 makes slide contact with a first contact surface 62C (described below) provided on the right side wall 62 of a main tray 60 or a second contact surface 72C (see FIG. 6) provided on a second tray 70 in the tray unit 50. Accordingly, the arm 22 pivots such that the feed rollers 23 come into contact with a top surface of first sheets 54A or a top surface of second sheets 54B (see FIG. 2) that are stored in the tray unit 50.

The rotation of the shaft 21 is transmitted to feed rollers 23 through a plurality of transmission gears (not shown) attached to the arm 22, and the feed rollers 23 are rotated accordingly. A control circuit controls a motor to rotate the feed rollers 23 such that the sheets 54 (see FIG. 2) are fed backward. Each of the sheets 54 that have been fed backward is conveyed by the sheet conveyor 30, which will be described below.

As shown in FIG. 2, the sheet conveyor 30 comprises a convey path 31 and four pairs of convey rollers 32-35. The convey path 31 is formed by a main convey path 31A and a return path 31B. The four pairs or convey rollers 32-35 are a pair of convey rollers 32, a pair of discharge rollers 33, a pair of switchback rollers 34, and a pair of return rollers 35.

The main convey path 31A is defined by a plurality of guide members 36 and a platen 37. The main convey path 31 curves upward from the back end of the tray unit 50 and then extends linearly forward. The platen 37 is positioned above the tray unit 50, and defines a part of a linearly extending portion of the main convey path 31.

The return path 31B is defined by a guide member 38 and a guide member 39 (see FIG. 3). The return path 31B passes between the platen 37 and the tray unit 50, and each end of the return path 31B merges with the main convey path 31A at a front portion and a back portion of the platen 37.

Figure 3A:
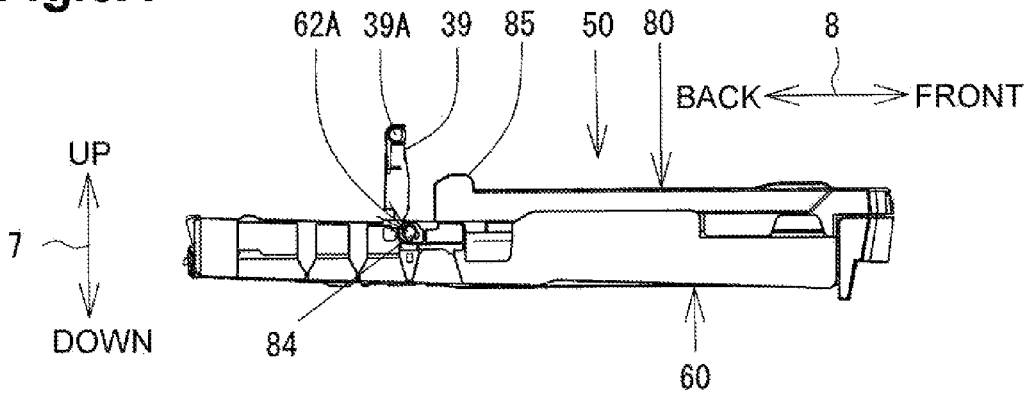
FIGS. 3A-3C are side views of a tray unit and a convey path forming member and show positional relations when the tray unit is mounted into a printer housing.
Figure 3B:
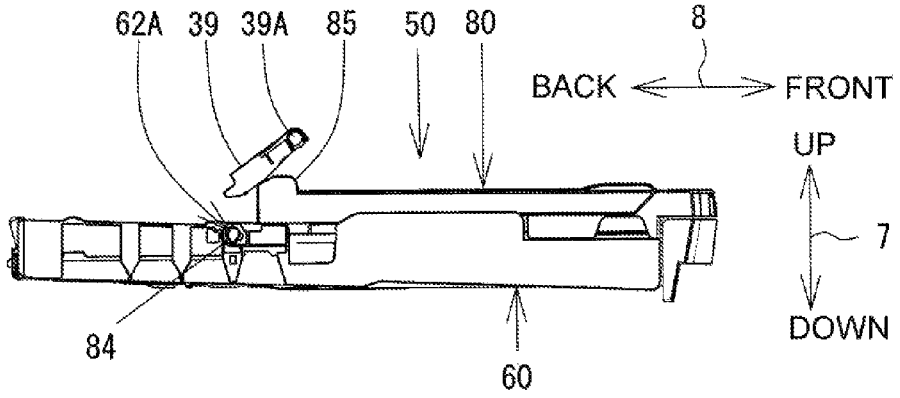
Figure 3C:
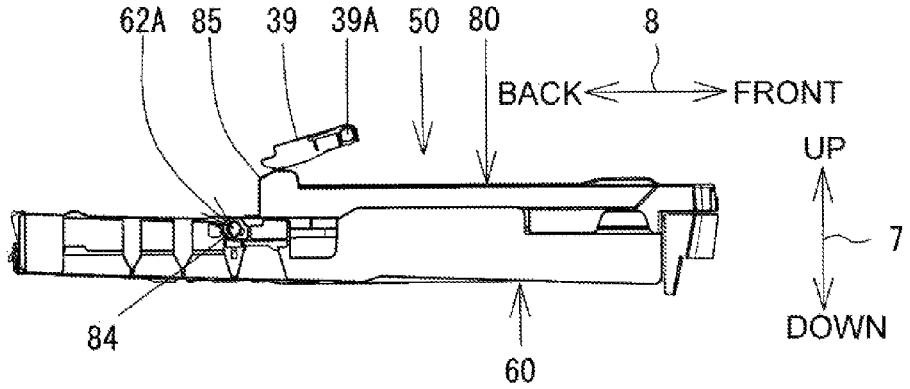

The guide member 39 is supported by the above-described frame or the like and is pivotable about a shaft 39A shown in FIG. 3. The guide member 39 pivots between a guide position (see FIG. 3C) in which the guide member 39A defines the return path 31B and guides a sheet, and an open position (see FIG. 3A) in which the guide member 39 opens the return path 31B for maintenance purposes.

The guide member 39 is held in the convey path forming position by projections 85 (described below) of the tray unit 50. When a paper jam occurs in the return path 31B, the tray unit 50 is withdrawn by a user from the printer housing 12. The guide member 39, which is not held by the tray unit 50 any more, pivots by its own weight from the guide position (see FIG. 3C) to the open position (see FIG. 3A). This allows the user to remove the jammed sheet 54. Paper jam elimination can be carried out simply by withdrawing the tray unit 50. When the tray unit 50 is mounted back to the printer housing 12, the projections 85 of the tray unit 50 push the guide member 39 from the open position to the guide position, as shown in FIGS. 3A-3C. The return path is defined by mounting the tray unit 50. The projections 85 are each an example of a contact portion.

As shown in FIG. 2, the convey rollers 32 comprise a driving roller 32A that is rotated by the above-described drive unit and a driven roller 32B that is rotated by the rotation of the driving roller 32A. The discharge rollers 33 comprise a drive roller 33A that is rotated by the above-described drive unit and a driven roller 33B that is rotated by the rotation of the drive roller 33A. The convey rollers 32 are disposed behind the platen 37. The discharge rollers 33 are disposed in front of the platen 37 in the front-back direction 8. The driving roller 32A of the convey rollers 32 and the driving roller 33A of the discharge rollers 33 are controlled to rotate by the above-described control circuit in a direction for conveying the sheet 54 forward. The sheet 54 is conveyed along the platen 37 by at least one of the pair of convey rollers 32 and the pair of discharge rollers 33.

The switchback rollers 34 comprise a driving roller 34A rotated by the above-described drive unit and a driven roller 34B rotated by the rotation of the driving roller 34A. The switchback rollers 34 are disposed in front of the discharge rollers 32 and above a central part of the tray unit 50 in the front-back direction 8. The switchback roller 34A is controlled by the above-described control circuit to rotate in one direction to discharge the sheet 54 and in the other direction to convey the sheet 54 to the return path 31B. The switchback rollers 34 are an example of a discharging unit.

The return rollers 35 comprise a driving roller 35A rotated by the above-described drive unit and a driven roller 35B rotated by the rotation of the driving roller 35A. The return rollers 35 convey the sheet 54 to the upstream side of the platen 37 in the main convey path 31A. The sheet 54 conveyed by the return rollers 35 is flipped over and passes again the platen 37.

The recording unit 40 comprises a carriage 41 disposed above the platen 37 and a head 42 retained by the carriage 41. The carriage 41 is supported by guiderails (not shown) such that the carriage 41 is movable in the left-right direction 9. The recording unit 40 ejects ink from the head 42 toward the sheet 54 that is conveyed along the platen 37. Owing to the movement of the recording unit 40 in the left-right direction 9 and the forward movement of the sheet 54, the recording unit 40 is capable of recording an image over substantially the entire area of the sheet 54. Instead of using the recording unit 40 that records an image with ink, a recording unit that records an image with toner may be used.

The control circuit controls the above-described motors to move the recording unit 40. The sheet 54 is intermittently conveyed on the platen, and the recording unit 40 ejects ink onto the sheet 54 being stopped. The control circuit controls the drive unit such that the switchback rollers 34 discharge the sheet 54 when single-sided printing is instructed and that the switchback rollers 34 convey the sheet 54 to the return path 31B when double-sided printing is instructed. Under the control by the control circuit, the return rollers 35 conveys the sheet 54 to the platen while the sheet 54 is flipped over, the recording unit 40 records an image on a back side of the sheet 54, and the switchback rollers discharge the sheet 54 having images on both sides. The tray unit 50 receives the discharged sheet 54.

Figure 6:
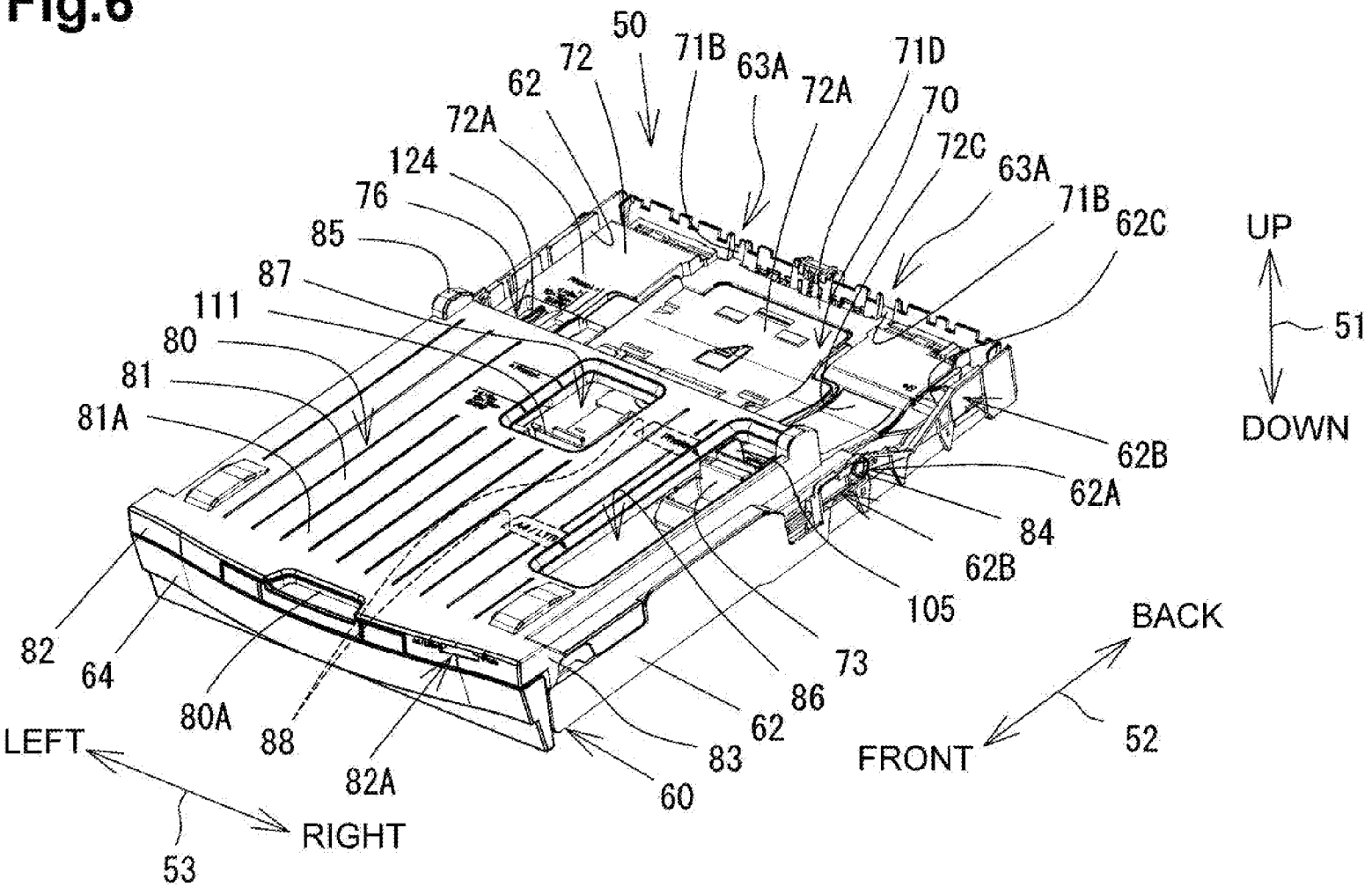
FIG. 6 is a perspective view of the tray unit when a second tray is in a feeding position and a discharge tray is in a receiving position.
Figure 7:
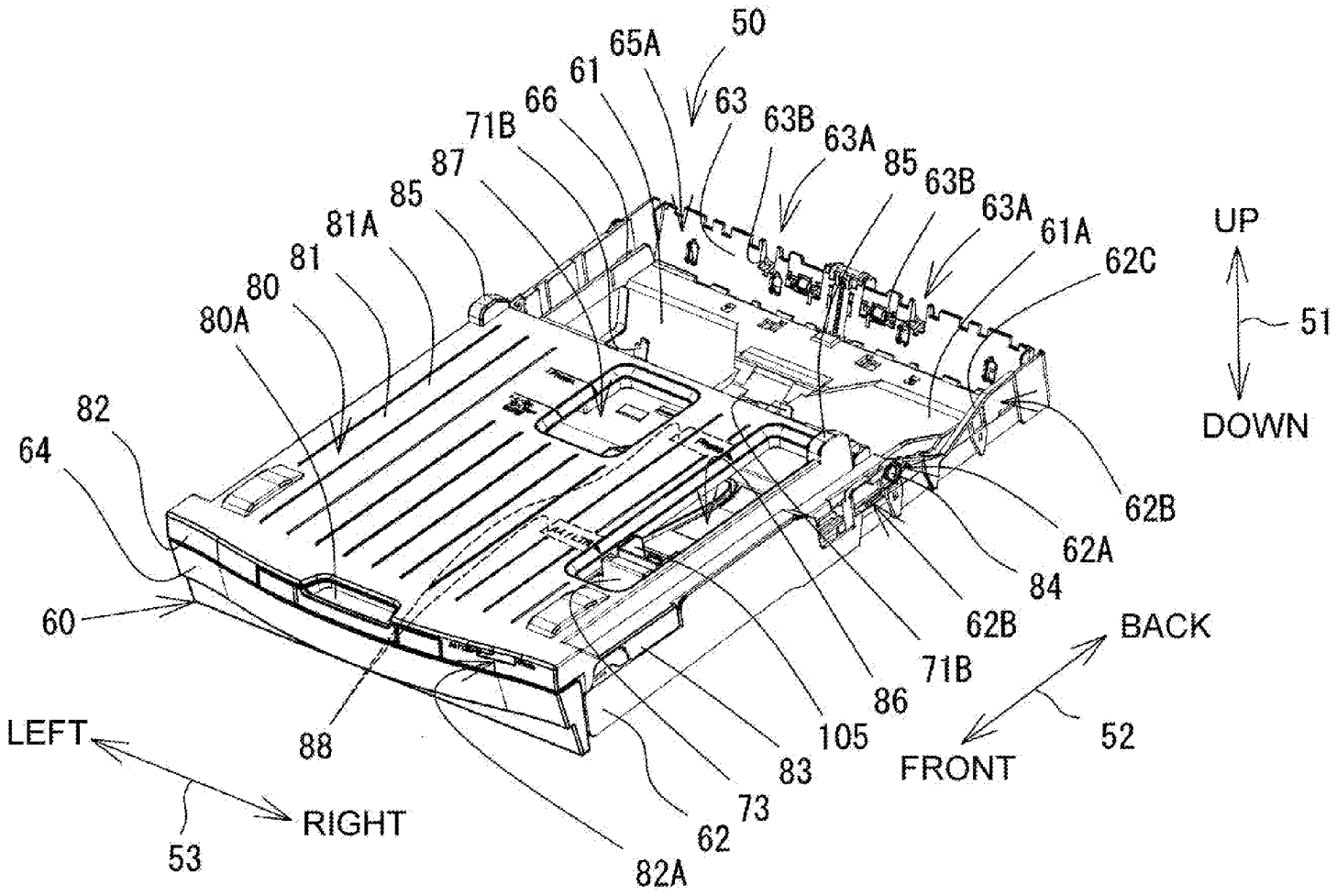
FIG. 7 is a perspective view of the tray unit when the second tray is in a retracted position and the discharge tray is in the receiving position.

As shown in FIG. 6, the tray unit 50 has a flattened rectangular parallelepiped external shape, and comprises the main tray 60, the second tray 70 positioned above the main tray 60, and a discharge tray 80 positioned above the second tray 70. In the following description, the thickness direction of the tray unit 50 is defined as an up-down direction 51 of the tray unit 50, the depth direction of the tray unit 50 is defined as a front-back direction 52 of the tray unit 50, and the width direction of the tray unit 50 is defined as a left-right direction 53 of the tray unit 50. When the tray unit 50 is mounted into the printer housing 12, the up-down direction 7, the front-back direction 8, and the left-right direction 9 of the main unit 11 of the ink recording device 10 are aligned with the up-down direction 51, the front-back direction 52, and the left-right direction 53 of the tray unit 50, respectively. The main tray 60 is an example of a first tray. The discharge tray 80 is an example of a cover and a discharged sheet receiver.

Figure 4:
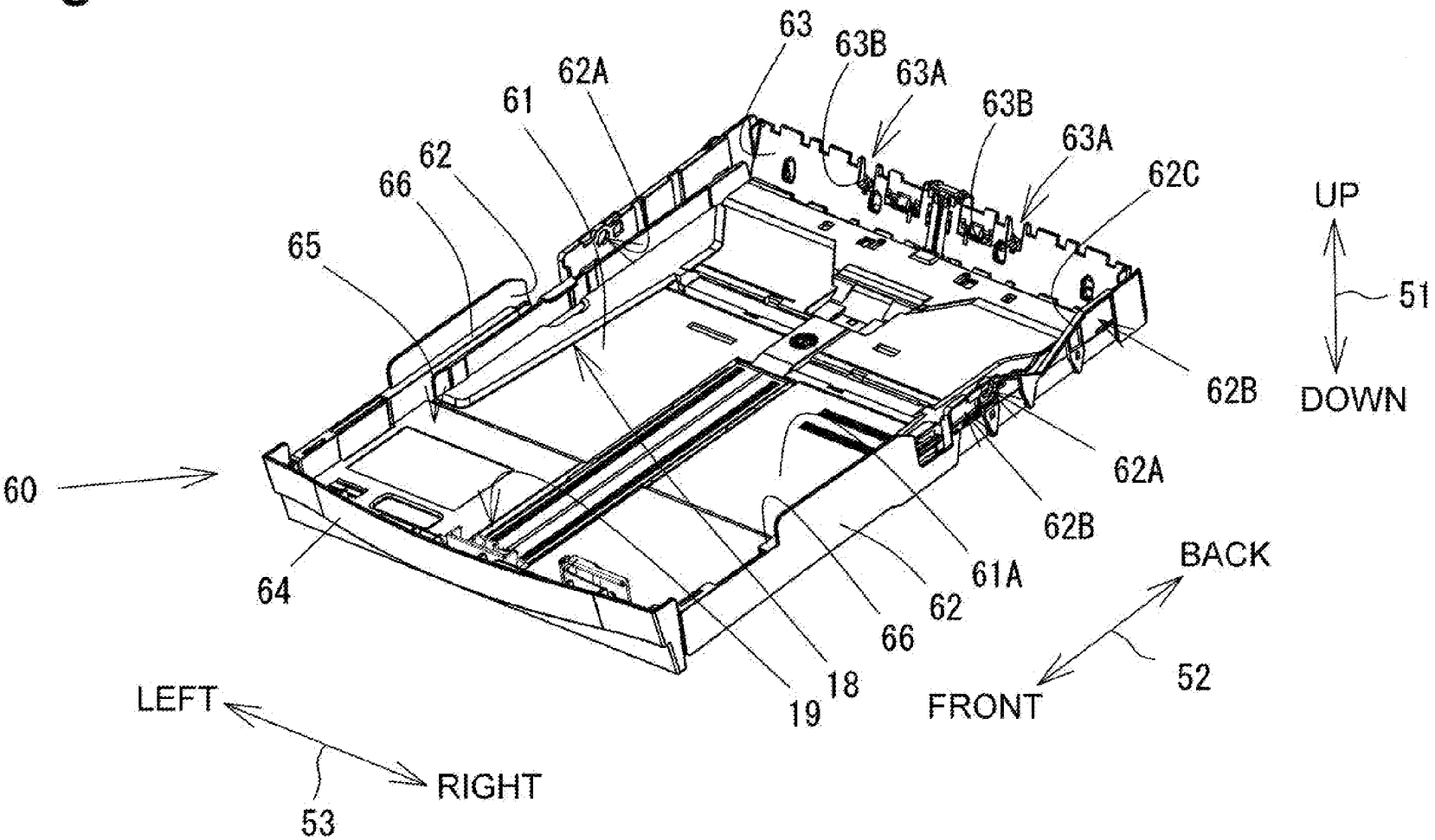
FIG. 4 is a perspective view of a main tray.
Figure 5:
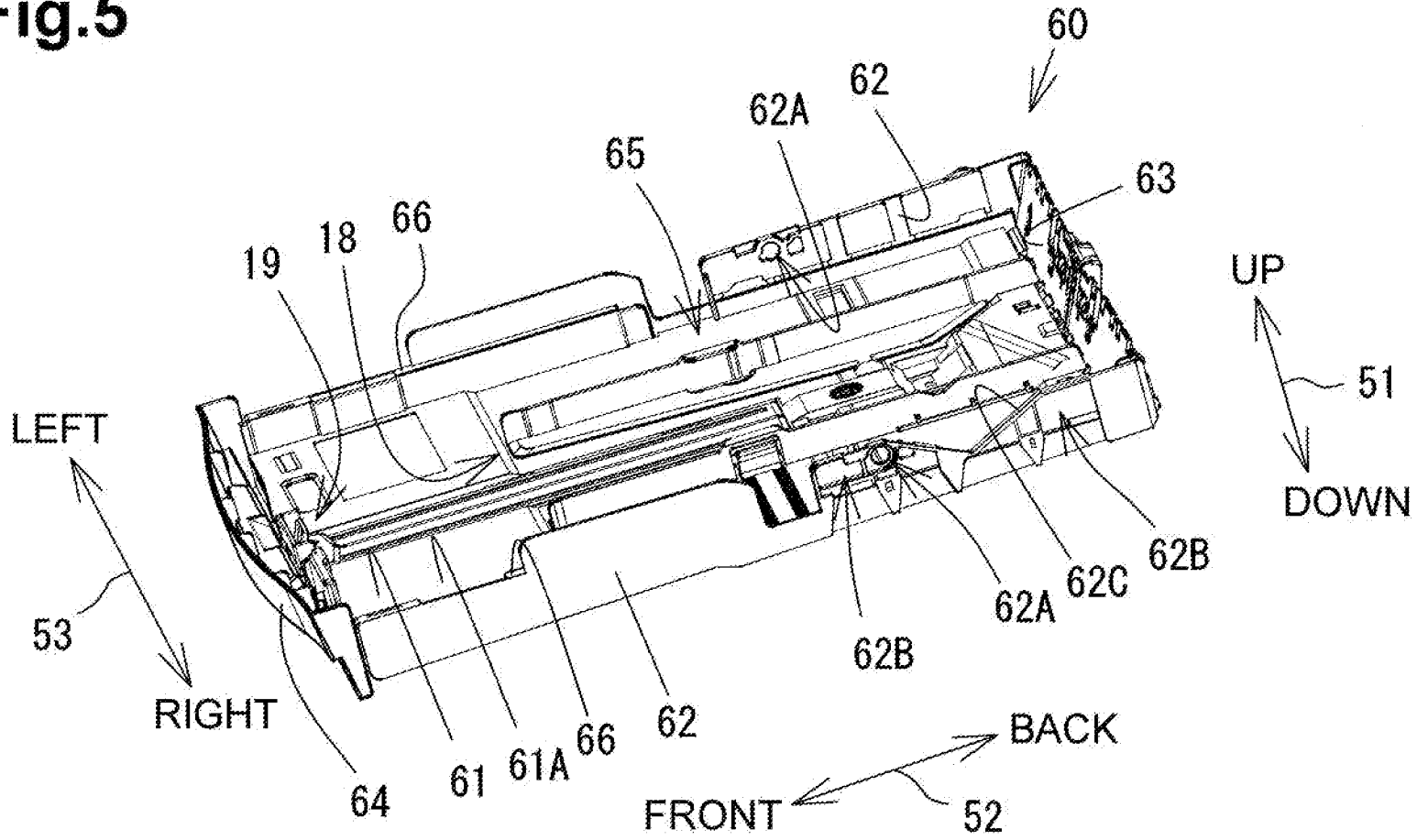
FIG. 5 is a perspective view of the main tray from an angle different from that of FIG. 4.

As shown in FIGS. 4 and 5, the main tray 60 has the shape of a box that is open at the top, and comprises a rectangular plate-shaped bottom 61 on which the first sheets 54A (see FIG. 2) can be placed, left and right side walls 62, a back wall 63, and a front wall 64. The first sheets 54A (see FIG. 2) are placed on an inner bottom surface 61A of the main tray 60. The inner bottom surface 61A is an example of a first holding surface.

The back wall 63 is inclined with respect to the bottom 61 such that the back wall 63 extends obliquely upward and backward from a back end portion of the bottom 61. Each of the first sheets 54A and the second sheets 54B fed by the above-described feeder 20 (see FIG. 2) is conveyed obliquely upward and backward by sliding along an inner surface of the back wall 63. Thus, the back wall 63 has a function of guiding each sheet 54 to the convey path 31 (see FIG. 2).

As shown in FIG. 6, the back wall 63 has left and right notches 63A. Fitting pieces 71B, which will be described below, formed on the second tray 70 are fitted to the notches 63A. The notches 63A are formed into a substantially rectangular shape by cutting out the top edge of the back wall 63. The notches 63A have a function to position the second tray 70 in the left-right direction 53, as will be described below.

The back wall 63 comprises engaging portions 63B in the notches 63A. The engaging portions 63B engage with engaged portion (not shown) of the fitting pieces 71B of the second tray 70, thereby to hold the second tray 50 in the feeding position.

The left and right side walls 62 comprise guiderails 66 for supporting the second tray 70 and shaft holes 62A for supporting the discharge tray 80. A front portion of each guiderail 66 in the front-back direction 52 is provided on the inner surface of the side wall 62 so as to support the second tray 70 at the top surface of the guiderail 66. A back portion of each guiderail 66 is formed in the side wall 62 as a groove extending in the front-back direction 52 so as to support the second tray 70 in the groove. The guiderails 66 support the second tray 70 such that the second tray 70 is slidable in the front-back direction 52. The shaft holes 62A are formed through the side walls 62, and projecting shafts 84 of the discharge tray 80, which will be described below, are inserted through the shaft holes 62A, respectively. Each shaft hole 62A is provided between a central part and the back end of the corresponding side wall 62 in the front-back direction 52.

Front and back lock holes 62B are formed in the right side wall 62. As described below, the lock holes 62B have a function of fixing a sliding portion 71 of the second tray 70.

The right side wall 62 has, as a part of the top surface thereof, the first contact surface 62C whose height decreases toward the front. When the tray unit 50 is withdrawn from the printer housing 12 while the second tray 70 is in a retracted position which will be described below, the arm 22 (see FIG. 2) makes slide contact with the first contact surface 62C such that the feed roller 23 moves up. When the tray unit 50 is mounted into the printer housing 12 while the second tray 70 is in the retracted position, the arm 22 makes slide contact with the first contact surface 62C such that the feed roller 23 moves down and contact the first sheet 54A.

A side guide mechanism 18 and a rear guide mechanism 19 are provided on the bottom 61 of the main tray 60 to properly position the first sheets 54A (see FIG. 2) on the bottom 61 of the main tray 60. The structures of the side guide mechanism 18 and the rear guide mechanism 19 are similar to those of a side guide mechanism 122 and a rear guide mechanism 110 (see FIG. 10) provided on the second tray 70, and explanations thereof are thus omitted here.

Figure 10:
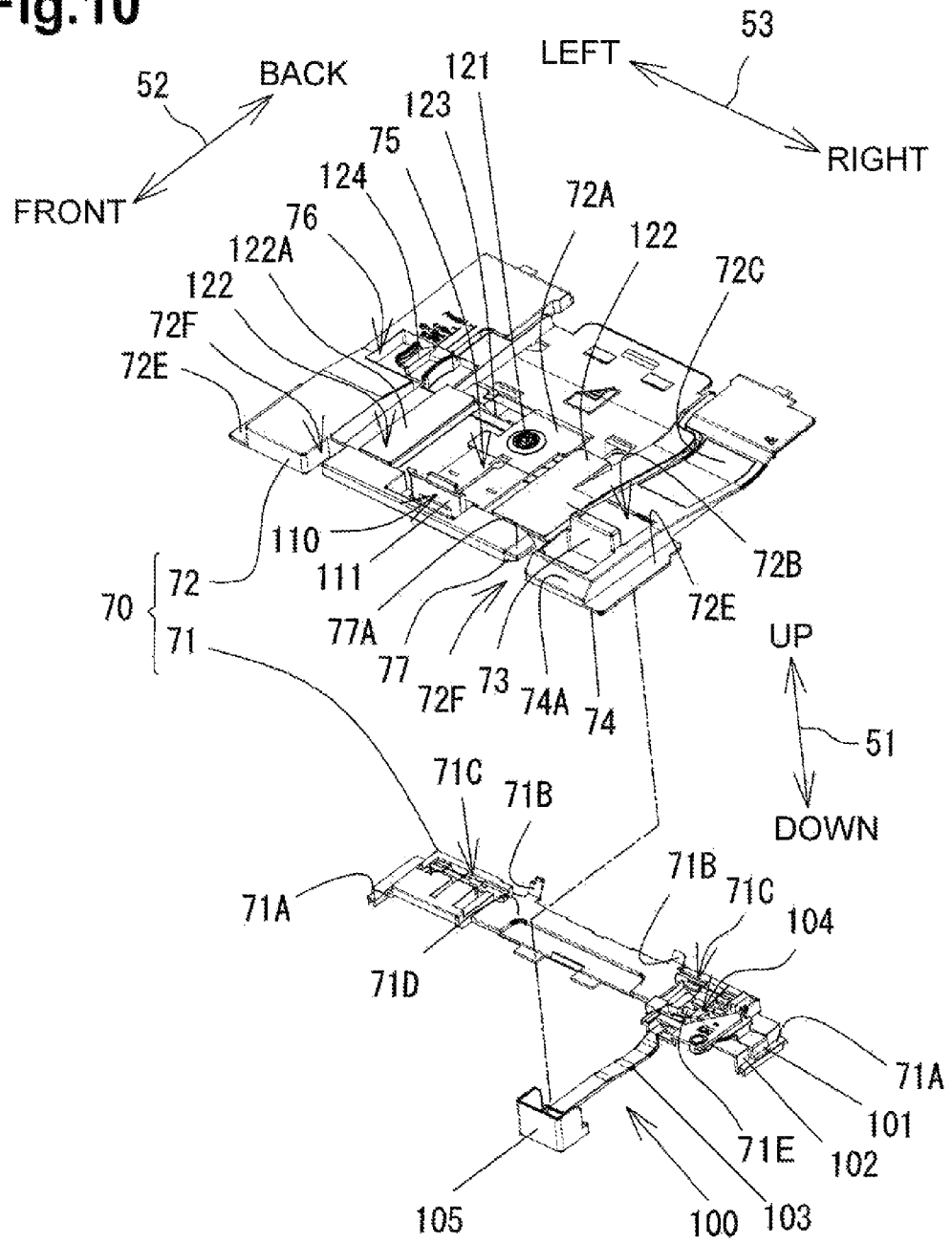
FIG. 10 is an exploded perspective view of the second tray.

As shown in FIG. 10, the second tray 70 comprises a rectangular plate-shaped sliding portion 71 that extends in the left-right direction 53 and a rectangular plate-shaped pivoting portion 72. The second sheets 54B are placed on a second holding surface 72A, which is the top surface of the pivoting portion 72, and a second holding surface 71D, which is the top surface of the sliding portion 72. The second holding surface 72A is an example of a second holding surface. The first sheets 54A and the second sheets 54B may either be different types of sheets or the same type of sheets.

As shown in FIG. 10, first flanges 71A project from the left and right ends of the sliding portion 71. The first flanges 71A are supported by the above-described guiderails 66 (see FIG. 6) provided on the main tray 60. The first flanges 71A slide along the groove-shaped portions of the guiderails 66 provided at the side walls 62. Accordingly, the sliding portion 71 moves in the front-back direction 52. Thus, the sliding portion 71 is supported by the main tray 60 such that the sliding portion 71 is slidable in the front-back direction 52.

The left and right fitting pieces 71B are provided at the back end of the sliding portion 71. The fitting pieces 71B project upward and backward from the back end of the sliding portion 71. When the second tray 70 is in the feeding position, the fitting pieces 71B are fitted to the notches 63A (see FIG. 4) formed in the back wall 63 of the main tray 60. As a result, the second tray 70, when in the feeding position, is properly positioned in the left-right position 53. First support portions 71C are provided on left and right parts of the sliding portion 71 to pivotally support the pivoting portion 72.

A locking mechanism 100 is provided on the right part of the sliding portion 71. The locking mechanism 100 comprises a lock member 101, a retaining portion 102, a first spring 71E, a connecting bar 103, a second support portion 104, a release lever 105, and a transmission mechanism (not shown). The lock member 101 is supported by the retaining portion 102 such that the lock member 101 is movable in the left-right direction 53. The first spring 71E urges the lock member 101 rightward. The second support portion 104 supports an end of the connecting bar 103 such that the connecting bar 103 is pivotable and is movable in the front-back direction 52. The connecting bar 103 pivots between a position to project forward from the sliding portion 71 and a position to project upward from the sliding portion 71. The connecting bar 103 moves in the front-back direction 52 when the connecting bar 103 is in the position to project forward from the sliding portion 71. The release lever 105 projects upward from a front end of the connecting bar 103 when the connecting bar 103 is in the position to project forward from the sliding portion 71.

When the release lever 105 is moved forward in FIG. 10 by a user, the transmission mechanism moves, in response to a movement of the connecting bar 103, the lock member 101 leftward against the urging force applied by the first spring 71E. Thus, the lock member 101 is moved from a projecting position shown in FIG. 10 to a retracted position.

Figure 11:
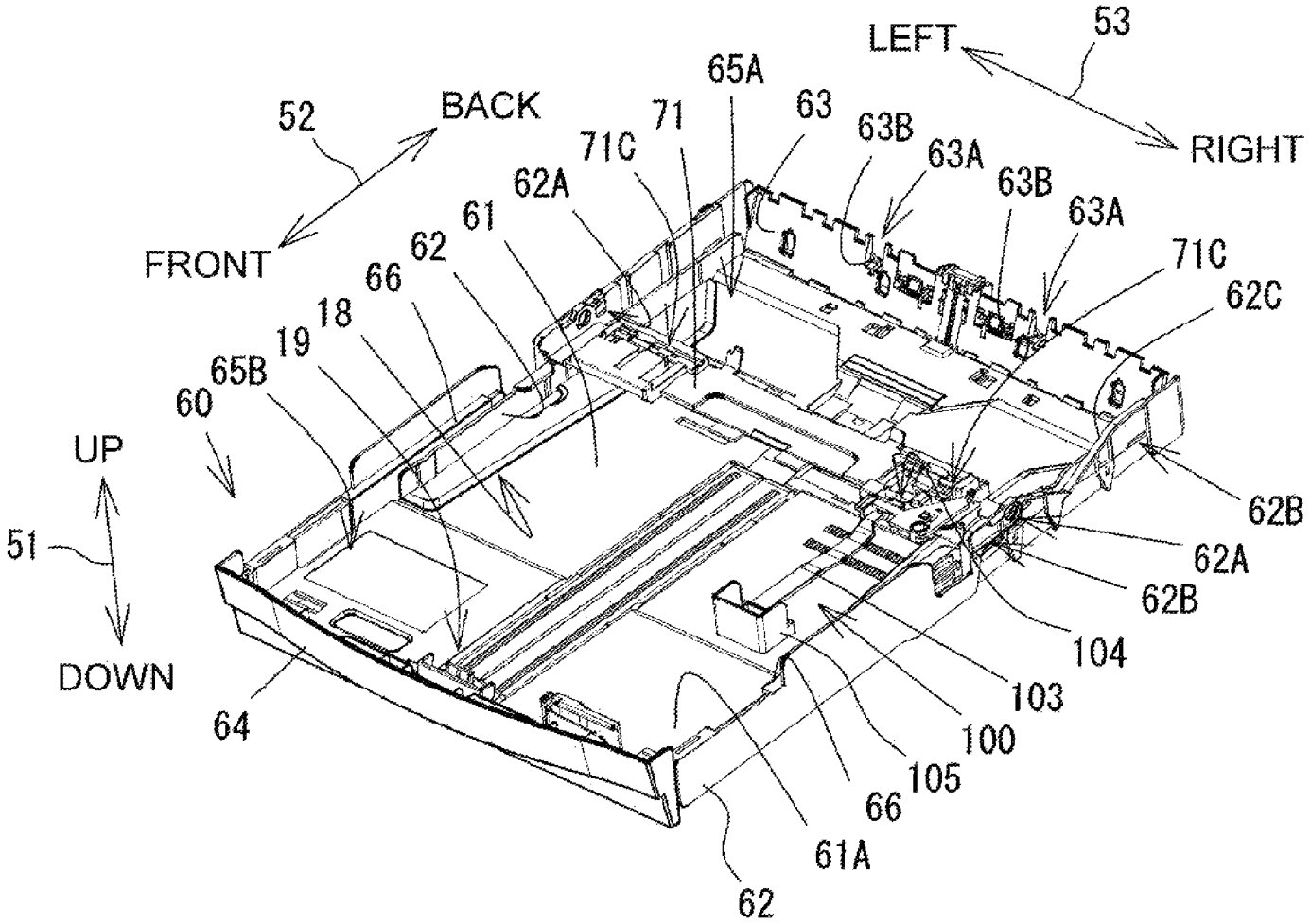
FIG. 11 is a perspective view showing a state in which a sliding portion of the second tray is supported by the main tray.

As shown in FIG. 11, the lock member 101 which is in the projecting position is fitted into the one of the lock holes 62B to thereby disable the sliding portion 71 to slide in the front-rear direction. Thus, the sliding portion 71 is fixed to the main tray 60. The second tray 70 slides between a front position and a back position. When the second tray 70 is in the front position, the lock member 101 is fitted into the front lock hole 62B. When the second tray 70 is in the back position, the lock member 101 is fitted into the back lock hole 62B. The lock holes 62B are an example of first positioning members, and the lock member 101 is an example of a second positioning member.

Left and right second flanges 72E project from the left and right sides of the pivoting portion 72, which is rectangular plate-shaped. The second flanges 72E and the above-described first flanges 71A are supported on the top surfaces of the guiderails 66 (see FIG. 11) of the main tray 60. Thus, both the pivoting portion 72 and the sliding portion 71 are slidably supported by the main tray 60.

The pivoting portion 72 is supported on the first support portions 71C of the sliding portion 71 in a pivotable manner. The pivot axis of the pivoting portion 72 coincides, in position, with the pivot axis of the connecting bar 103 and moves as the sliding portion 72 slides. When the sliding portion 71 is in the front position, the pivot axis of the pivoting portion 72 substantially coincides, in position, with the pivot axis of the discharge tray 80. As will be described below, the discharge tray 80 is supported by the main tray 60 at the shaft holes 62A in a pivotable manner. It is not necessary that the pivot axis of the pivoting portion 72 and the pivot axis of the discharge tray 80 precisely coincide, in position, with each other as long as the pivoting portion 72 and the discharge tray 80 are pivotable. However, it is preferable that the pivot axis of the pivoting portion 72 substantially coincides, in position, with the pivot axis of the discharge tray 80 in order for the pivoting portion 72 and the discharge tray 80 to pivot integrally. In this case, the pivoting portion 72 and the discharge try 80 pivot smoothly while positional displacement with relative to each other is prevented. The pivoting portion 72 pivots between a lying position in which the second holding surface 72A faces upward and extends along the inner bottom surface 61A (first holding surface) of the main tray 60, and a standing position in which the second holding surface 72A stands upward with respect to the inner bottom surface 61A.

Figure 8:
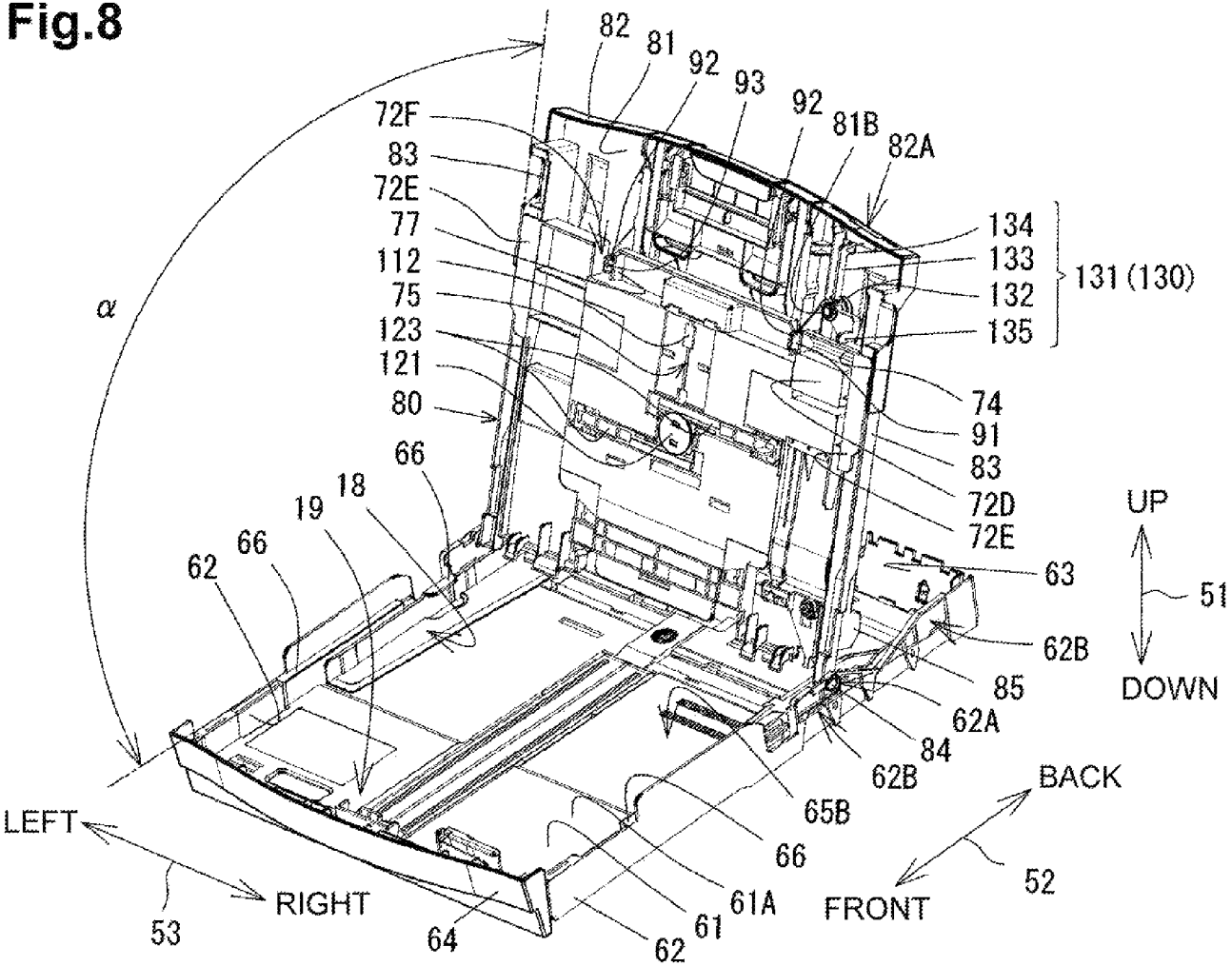
FIG. 8 is a perspective view of the tray unit when the second tray is in an open position and the discharge tray is in a loading position.
Figure 12:
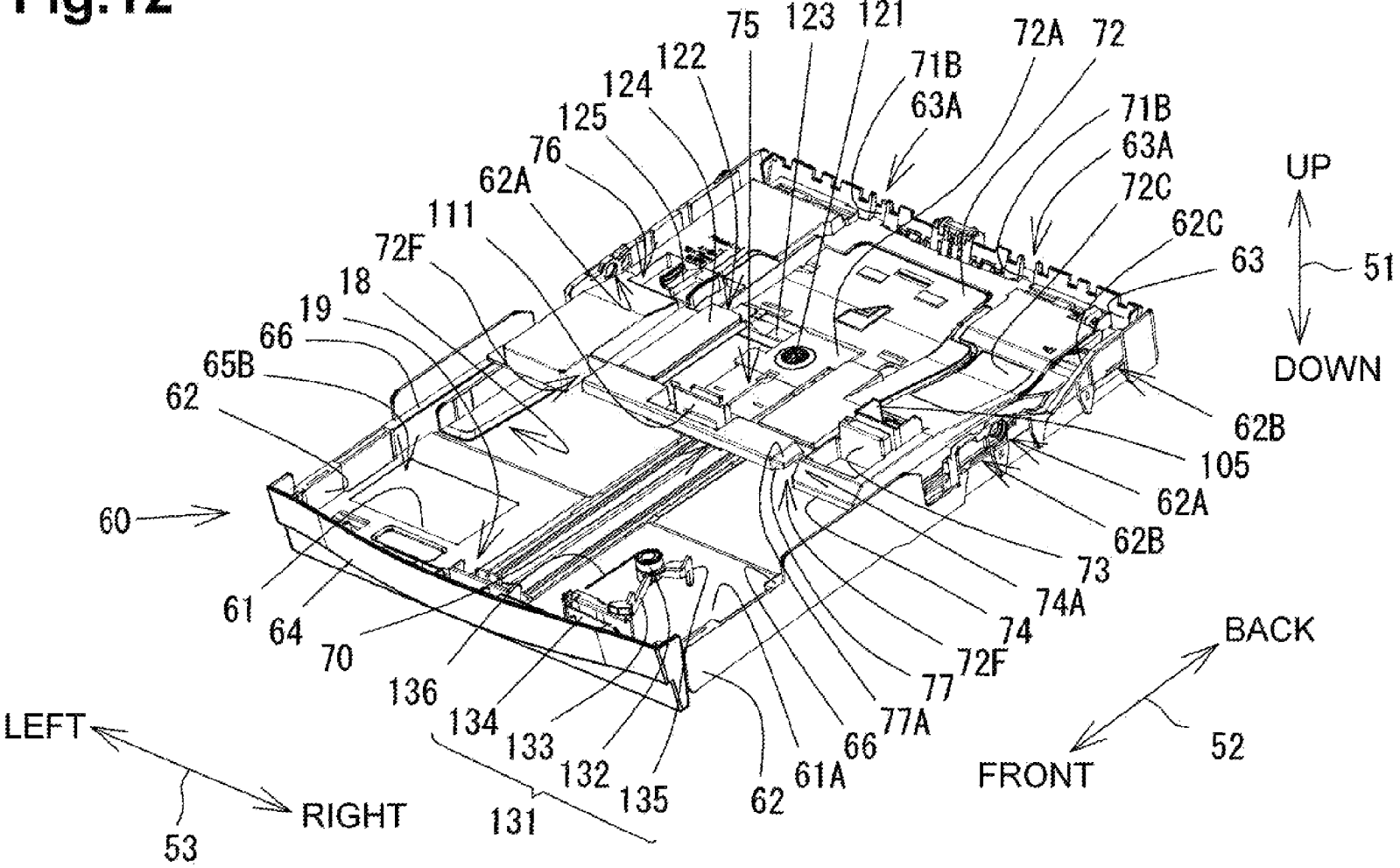
FIG. 12 is a perspective view of the tray unit from which the discharge tray is removed and in which the second tray is in the feeding position.
Figure 13:
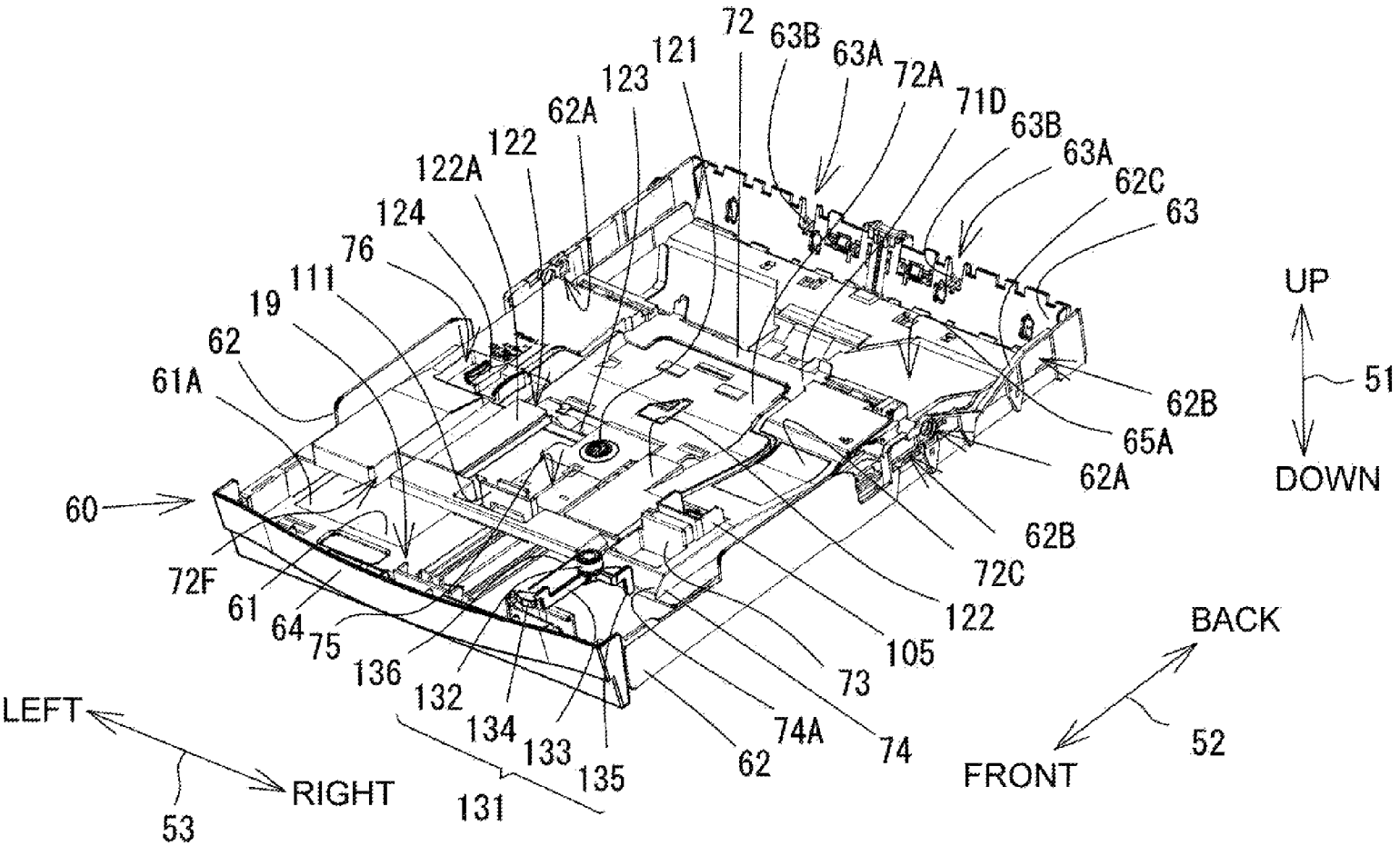
FIG. 13 is a perspective view of the tray unit from which the discharge tray is removed and in which the second tray is in the retracted position.

In the following description, the second tray 70 is described as being in a feeding position when the sliding portion 71 is in the above-described back position and the pivoting portion 72 is in the above-described lying position, as shown in FIG. 12. The second tray 70 is described as being in a retracted position when the sliding portion 71 is in the above-described front position and the pivoting portion 72 is in the lying position, as shown in FIG. 13. The second tray 70 is described as being in an open position when the sliding portion 71 is in the front position and the pivoting portion 72 is in the standing position, as shown in FIG. 8. The feeding position is an example of a first second-tray position, the retracted position is an example of a second second-tray position, and the open position is an example of a third second-tray position. As shown in FIG. 6, the pivoting portion 72, when in the feeding position, is located at a feeding port 65A (see FIG. 7) which is a back part of the opening 65 of the main tray 60. As shown in FIG. 13, the pivoting portion 72, when in the retracted position, is at a loading port 65B (see FIG. 12) and closes the loading port 65A which is a front part of the opening 65. As shown in FIG. 8, the pivoting portion 72, when in the open position, open the loading port 65B. In the following description, the pivoting portion 72 is described as being in the lying position unless otherwise specified. When the second tray 70 is in the feeding position, the second holding surface 72A faces the feed rollers 23 of the feeder 20. Accordingly, the second sheets 54B placed on the second holding surface 72A are fed toward the recording unit 40. When the second tray 70 is in the retracted position, the inner bottom surface 61A (first holding surface) of the main tray 60 faces the feed rollers 23. Accordingly, the first sheets 54A placed on the inner bottom surface 61A are fed toward the recording unit 40.

As shown in FIG. 10, the pivoting portion 72 has, in the right part thereof, an insertion hole 72B into which the release lever 105 is inserted from below. An operation lever 73 projects upward from the top surface of a peripheral wall around the insertion hole 72B at the front side thereof. The operation lever 73 faces, in the front-back direction 52, the release lever 105 that is inserted into the insertion hole 72B from below. The user pulls the release lever 105 toward the operation lever 73 by the fingers, so that the lock member 101 is released from the lock hole 62B. Then, the user moves the operation lever 73 and the release lever 105 in the front-back direction 52, thereby sliding the second tray 70. By releasing the release lever 105 when the sliding portion 71 reaches the front position or the back position, the lock member 101, which is urged by the first spring 71E, is fitted into the front lock hole 62B or the back lock hole 62B. The user recognizes that the sliding portion 71 has reached the front position or the back position from a tactile sensation or a sound generated when the lock member 101 is fitted into one of the lock holes 62B. Thus, the second tray 70 is prevented from being left in an intermediate position.

The pivoting portion 72 comprises a support cover 72D (see FIG. 8) disposed below the connecting bar 103. The support cover 72D supports the release lever 105 such that the release lever 105 pivots integrally with the pivoting portion 72 and moves in the front-back direction relative to the pivoting portion 72.

The pivoting portion 72 has the second contact surface 72C as a part of the top surface thereof. The second contact surface 72C is provided on the right part of the pivoting portion 72, and is inclined such that the height thereof decreases toward the front. When the tray unit 50 is mounted into the printer housing 12 (see FIG. 1) while the second tray 70 is in the above-described feeding position, the above-described arm 22 (see FIG. 3) makes slide contact with the second contact surface 72C such that the feed rollers 23 are lowered and come into contact, from above, with a top surface of the second sheets 54B (see FIG. 2) placed on the pivoting portion 72. The height of the pivoting portion 72 is set such that the second holding surface 72A of the pivoting portion 72, when in the lying position, is below the upper end of the back wall 63 of the main tray 60. Accordingly, similarly to the first sheets 54A, the second sheets 54B on the second holding surface 72A are guided by the back wall 63 to the main convey path 31A. The sheets 54 subjected to image recording are switched by sliding the second tray 70 by the user.

As will be described below, an indicating mechanism 130 provided on the discharge tray 80 indicates whether the second tray 70 is in the feeding position or the retracted position, that is, whether the first sheets 54A or the second sheets 54B are subjected to image recording. A contact portion 74 for changing the indication by the indicator is provided in the right part of the front end of the pivoting portion 72. The contact portion 74 has an inclined surface 74A that descends frontward. The contact portion 74 is an example of a second-tray contact portion.

As shown in FIG. 8, the pivoting portion 72 has left and right cut portions 72F which are formed at a pivoting end of the pivoting portion 72. The pivoting portion 72 comprises left and right engagement ribs 77. The left engagement rib 77 partially defines the left cut portion 72F. The right engagement rib 77 partially defines the right cut portion 72F. Hook pieces 92, which will be described later, project toward a lower side of the pivoting portion 72, which is opposite to the second holding surface 72A, and engage with the engagement ribs 77. Each engagement rib 77 has an inclined surface 77A which tapers toward its tip and is inclined downward and in a direction away from the central part in the left-right direction 53. Each inclined surface 77 is inclined with respect to a pivoting direction of the discharge tray 80 (a circumferential direction around the pivot axis of the discharge tray 80) and is not perpendicular to the pivoting direction of the discharge tray 80. Because the engagement ribs 77 formed at the cut portions 72F allow the hook pieces 92 to be disposed behind the front end of the pivoting portion 72, the overall size of the tray unit 50 can be reduced. The engagement ribs 77 are an example of an engaged portion.

As shown in FIG. 10, the pivoting portion 72 has a guiding long hole 75 and an operation recess 76 in a front area thereof. The guiding long hole 75 extends through the pivoting portion 72 and in the front-back direction 52. The guiding long hole 75 is provided in a central part of the pivoting portion 72 in the left-right direction 53. The operation recess 76 is provided on a left part of the pivoting portion 72 and adjacent to the second holding surface 72A. The functions of the guiding long hole 75 and the operation recess 76 will be described below, along with a description of the rear guide mechanism 110 and the side guide mechanism 120.

As shown in FIG. 10, the rear guide mechanism 110 comprises a rear guide 111 placed on the second holding surface 72A so as to extend over peripheral walls at the left and right sides of the above-described guiding long hole 75; a guide piece (not shown) that projects downward from the rear guide 111 so as to extend through the guiding long hole 75; and a retaining portion 112 (see FIG. 8) arranged such that the peripheral walls at the left and right sides of the guiding long hole 75 are placed between the rear guide 111 and the retaining portion 112 in the thickness direction of the pivoting portion 72. Thus, the rear guide 111 is supported by the pivoting portion 72 such that the rear guide 111 is movable along the front-back direction 52. The user holds and moves the rear guide 111 such that the second sheets placed on the second holding surface 72A are sandwiched by the rear guide 111 and the above-described fitting pieces 71B provided on the sliding portion 71. Thus, the second sheets 54B are properly positioned in the front-back direction 52.

The side guide mechanism 120 comprises a pinion gear 121 that is rotatably retained in a central part of the pivoting portion 72 in the left-right direction 53; left and right side guides 122 arranged at the left and right sides of the pinion gear 121; left and right rack gears 123, each of which is coupled to the corresponding side guide 122 at one end thereof and is meshed with the pinion gear 121 at the other end thereof; and a lug 124 that is connected to the left side guide 122 and disposed in the above-described operation recess 76.

Each of the side guides 122 comprises a holding plate (not shown) that forms a part of the second holding surface 72A; a side plate (not shown) that stands upward with respect to the holding plate; and a top plate 122A that is supported by the side plate so as to face the holding plate in a direction perpendicular to the second holding surface 72A (up-down direction 51 in FIG. 10). In the left side guide 122, the side plate is connected to the left edge of the holding plate. In the right side guide 122, the side plate is connected to the right edge of the holding plate.

The length of the lug 124 in the left-right direction 53 is smaller than the length of the operation recess 76 in the left-right direction 53, and the lug 124 is movable along the left-right direction 53. When the user moves the lug 124 rightward or leftward, the left side guide 122 and the left rack gear 123 are moved leftward or rightward. When the left rack gear 123 is moved, the pinion gear 121 is rotated. Accordingly, the right rack gear 123 that meshes with the pinion gear 121 and the right side guide 122 are moved leftward or rightward in response to the rotation of the pinion gear 121. Thus, the pair of side guides 122 are moved toward or away from each other in association with each other. The user moves the lug 124 such that the side plates of the left and right side guides 122 sandwich the second sheets 54B placed on the second holding surface 72A. Thus, the second sheets 54B are properly positioned in the left-right direction 53. The second sheets 54B are properly positioned on the second holding surface 72A by the above-described rear guide mechanism 110, the fitting pieces 71B, and the side guide mechanism 120.

As shown in FIGS. 6 to 9, the discharge tray 80 comprises a rectangular plate-shaped base 81 that is capable of supporting the first sheets 54A and the second sheets 54B discharged by the switchback rollers 34, a front wall 82, left and right side walls 83, and left and right projecting shafts 84 that serve as a pivot shaft. The left and right projecting shafts 84 project from back end portions of the left and right side walls 83 in directions away from each other along the left-right direction 53. A discharged sheet holding surface 81A, which is an upper surface of the base 81, supports the discharged sheets 54. The discharge tray 80 is configured to cover at least a portion of the second tray 70 irrespective of whether the second tray 70 is in the feeding position or in the retracted position. Thus, the discharge tray 80 functions as a cover of the tray unit 50. The discharge tray 80 reduces the risk that dust will enter the main tray 60 or the second tray 70 and the risk that the sheets 54, the holding surfaces, etc., will be damaged when the tray unit 50 is transported alone or together with the image recording device 10.

The projecting shafts 84 are inserted into the above-described shaft holes 62A in the left and right side walls 62 of the main tray 60 from the inside of the side walls 62. Owing to the projecting shafts 84 and the shaft holes 62A, the discharge tray 80 is supported by the main tray 60 such that the discharge tray 80 is pivotable between a receiving position shown in FIGS. 6 and 7 and a loading position shown in FIGS. 8 and 9. When the discharge tray 80 is in the receiving position, a discharged sheet receiver, e.g., a discharged sheet holding surface 81A of the base 81 extends along the inner bottom surface 61A (first holding surface) of the main tray 60. When the discharge tray 80 is in the loading position, the discharged sheet holding surface 81A stands upward with respect to the inner bottom surface 61A of the main tray 60. The discharge tray 80 is an example of a cover and an example of a discharged sheet receiver. The receiving position is an example of a first cover position, and the loading position is an example of a second cover position. It is not necessary that the base 81 extend parallel to the inner bottom surface 61A of the main tray 60 when the base 81 is in the receiving position, as long as the base 81 extends substantially along the inner bottom surface 61A such that the discharged sheets 54 can be received by the base 81.

As described above, the pair of switchback rollers 54 that discharge the sheet 54 after an image is recorded thereon are disposed above a central part of the tray unit 50 in the front-back direction 8. In addition, each of the shaft holes 62A into which the projecting shafts 84 are inserted is provided between a central part and the back end of the corresponding side wall 62 of the main tray 60 in the front-back direction 52. Therefore, in the state in which the tray unit 50 is mounted in the printer housing 12, the back end of the base 81 of the discharge tray 80 in the receiving position is positioned below the switchback rollers 33, so that the discharge tray 80 can receive the sheet 54 having an image recorded thereon and discharged by the switchback rollers 33. The sheet 54 having the image recorded thereon is discharged by the discharge rollers 33 and slides, from a leading edge thereof in the discharging direction, that is, from a front edge thereof, along the discharge tray 80 in the receiving position or along the previously discharged sheet 54. Thus, the sheets 54 are stacked on the discharge tray 80.

The discharge tray 80 is provided with a holdable portion 80A at its pivoting end (front end in FIG. 6). The user holds the holdable portion 80A by the fingers and lifts the front end of the discharge tray 80 so that the discharge tray 80 is moved from the above-described receiving position to the loading position. Then, the user supplies the first sheets 54A to the main tray 60 through a loading port 65B (see FIG. 8), which is a front part of the opening 65.

When the discharge tray 80 is in the receiving position, a lower end of the front wall 82 is in contact with a top end of the front wall 64 of the main tray 60. The discharge tray 80 is retained in the receiving position while the front wall 82 is supported by the front wall 64 of the main tray 60 and the projecting shafts 84 are supported by the side walls 62 of the main tray 60.

Figure 9:
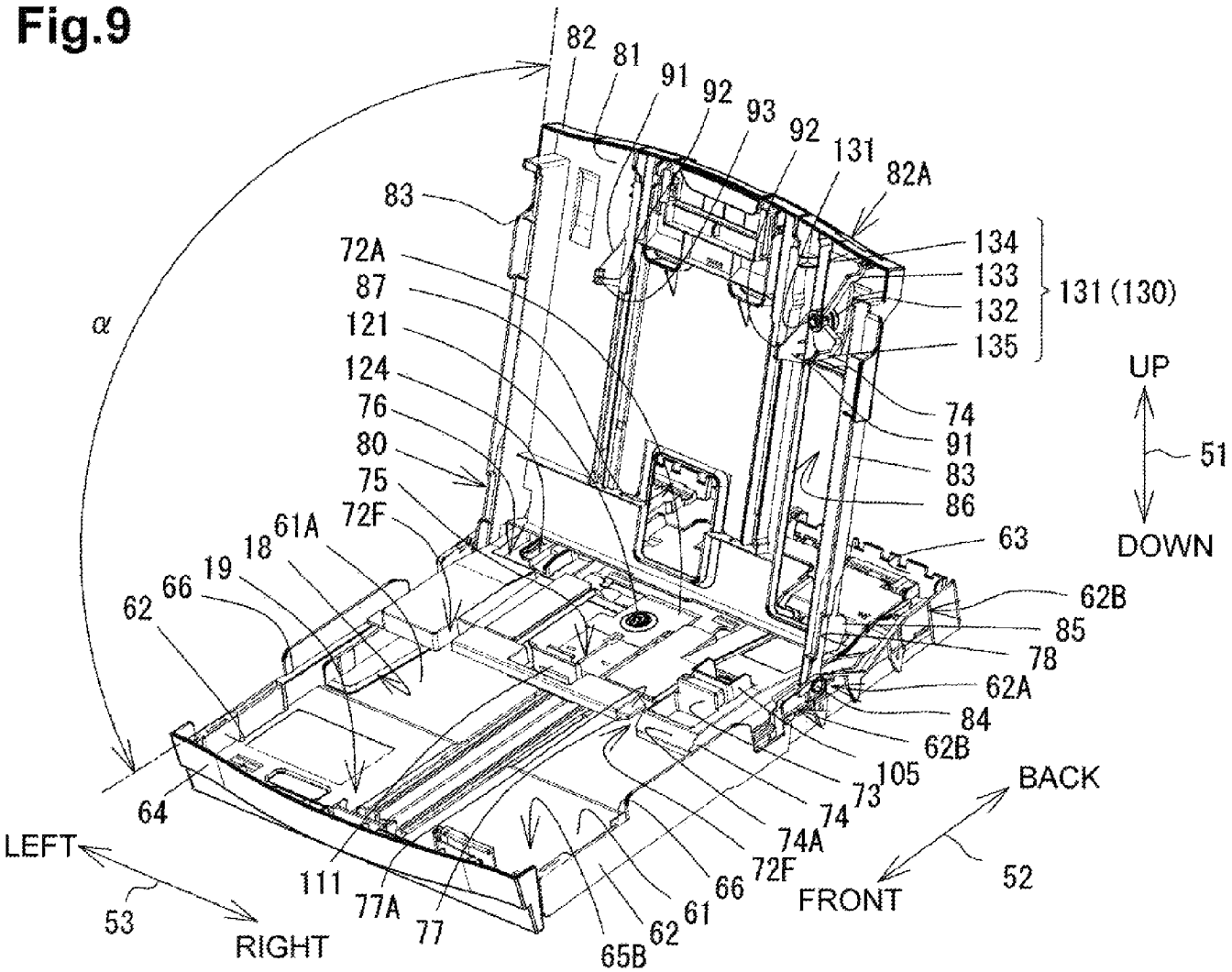
FIG. 9 is a perspective view of the tray unit when the second tray is in the feeding position and the discharge tray is in the loading position.

The projections 85 project from a back end portion of the discharged sheet holding surface 81A of the base 81 in FIG. 6. When the discharge tray 80 is opened while the second tray 70 is in the feeding position, the projections 85 come into contact with the pivoting portion 72 of the second tray 70. Thus, an opening angle $\alpha$ of the discharge tray 80 is determined by the projections 85. The projections 85 are disposed on the left and right sides of the discharge tray 80 so that the discharge tray 80 in the opened state does not come into contact with or damage the second sheets 54B placed on the second tray 70. The distance by which the projection 85 projects is set to a predetermined value. This value is determined such that the opening angle $\alpha$ of the discharge tray 80 is larger than 90 degrees (for example, 100 degrees), as shown in FIGS. 8 and 9. The projection 85 comes into contact with a receiving portion 7 (see FIG. 9) of the pivoting portion 72 of the second tray 70. Instead of the projections 85 provided on the discharge tray 80, the projections 85 may be provided on the pivoting portion 72 of the second tray 70. Alternatively, instead of the projections 85, stoppers that regulate the opening angle of the discharge tray 80 may be provided on the projecting shafts 84 of the discharge tray 80.

The projections 85 are positioned such that the projections 85 push the above-described guide member 39, which defines the return path 31B, when the tray unit 50 is mounted into the printer housing 12. Thus, the projections 85 have a function of limiting the opening angle $\alpha$ of the discharge tray 80 to protect the second sheets 54B and a function of changing the position of the guide member 39 to close the return path 31B. Although the projections 85 have the above-described two functions, separate components may be provided to achieve the above-described two functions.

The base 81 includes an opening, e.g., a first operation window 86 and a second operation window 87. The first operation window 86 extends through a right part of the base 81 in FIG. 6, and is formed as a rectangular hole that extends in the front-back direction 52 in FIG. 6. The above-described operation lever 73 and the release lever 105 are exposed to the outside of the tray unit 50 through the first operation window 86, over the entire sliding range of the second tray 70. The user slides the second tray 70 by operating the operation lever 73 and the release lever 105 through the first operation window 86. The operation lever 73 and the release lever 105 are arranged such that they do not project from the discharged sheet holding surface 81A. Therefore, the sheet 54 having an image recorded thereon and discharged by the switchback rollers 34 is prevented from being blocked by the operation lever 73 or the release lever 105 when the sheet 54 slides along the discharged sheet holding surface 81A.

Marks 88 are provided at an edge of the first operation window 86. Each mark 88 shows the information about the position of the second tray 70 or the information about the type of the sheets 54 subjected to image recording. The user recognizes the position of the second tray 70 or the type of the sheets 54 subjected to image recording from the information shown by the marks 88 and the position of the operation lever 73 and the release lever 105.

The second operation window 87 extends through the back end portion of the base 81 and in the central part in the left-right direction 53 in FIG. 6 of the base 81. The above-described rear guide 111 can be exposed to the outside of the tray unit 50 through the second operation window 87 when the second tray 70 is in the feeding position. The second operation window 87 has a rectangular shape whose dimension in the front-back direction 52 is somewhat larger than the dimension thereof in the left-right direction 53, so that the user can easily operate the rear guide 111.

As shown in FIGS. 8 and 9, the discharge tray 80 comprises left and right connecting pieces 91 and left and right hook pieces 92. The connecting pieces 91 project from the lower surface of the base 81 at the side opposite to the discharged sheet holding surface 81A. The hook pieces 92 project toward each other (toward the central part in the left-right direction) from lower ends of the connecting pieces 91 and extend in the front-back direction 52 by a length larger than the length by which the hook pieces 92 project. Thus, the hook pieces 92 are connected to the base 81 via the connecting pieces 91. The connecting pieces 91 are disposed outside the space in which the second tray 70 is moved. The connecting pieces 91 are each an example of a connecting member. The hook pieces 92 are each an example of an engaging portion. The hook pieces 92 extend in the front-back direction 52. Thus, even if the pivoting portion 72 is slightly moved relative to the discharge tray 80 in the radial direction of its pivoting movement, the hook pieces 92 are prevented from being disengaged from the engagement ribs 77. Alternatively, the connecting pieces 91 and the hook pieces 92 may be configured such that the hook pieces 92 project backward from the connecting pieces disposed at the front side.

The connecting pieces 91 and the hook pieces 92 are disposed closer to the pivoting end of the base 81 than to the pivot axis of the base 81. The distance between the left and right connecting pieces 91 is slightly larger than the distance between the engagement ribs 77 of the pivoting portion 72. The distance from the base 81 to the hook pieces 92 is slightly larger than the thickness of the pivoting portion 72 of the second tray 70. As described below, when the second tray 70 is slid, the above-described engagement ribs 77 are inserted between the base 81 and the hook pieces 92. More specifically, in the state in which the discharge tray 80 is in the receiving position and the second tray 70 is in the refracted position, the hook pieces 92 are positioned below the second tray 70.

When the discharge tray 80 is in the receiving position and the second tray 70 is in the retracted position, the top surface of the second tray 70 is covered by the base 81, the left and right side faces of the second tray 70 are covered by the left and right side walls 83, and the front face of the second tray 70 is covered by the front wall 82. The discharge tray 80 prevents dust from entering the second tray 70 when the second tray 70 is in the retracted position. The left and right side walls 83 and the front wall 82 of the discharge tray 80 are each an example of a cover portion.

Each hook piece 92 has an inclined surface 93. The inclined surface 93 is inclined such that the hook piece 92 becomes thinner toward its projecting end. The hook pieces 92, the connecting pieces 91, and the base 81 are formed integrally with each other by using synthetic resin material, and the connecting pieces 91 are elastically deformable. As described below, when the discharge tray 80 is moved from the loading position to the receiving position, each engagement rib 77 of the pivoting portion 72 slides along the corresponding inclined surface 93, thereby to smoothly bend the corresponding connecting piece 91. In the present embodiment, the inclined surface 77A is formed on the engagement rib 77 and the inclined surface 93 is formed on the hook piece 92. Alternatively, an inclined surface may be formed on only one of the engagement rib 77 and the hook piece 92. The inclined surface 93 is inclined with respect to a pivoting direction of the discharge tray 80 (a circumferential direction around the pivot axis of the discharge tray 80) and is not orthogonal to the pivoting direction.

An indication window 82A is formed in the front wall 82 of the discharge tray 80 such that an indicating portion 134 of an indicator 131 of the indicating mechanism 130, which will be described below, is exposed to the outside of the tray unit 50 thorough the indication window 80. In addition, as shown in FIG. 8, a shaft 81B projects from the lower surface of the base 81 at the side opposite to the discharge holding surface 81A. The shaft 81B supports the indicator 131 in a rotatable manner.

As shown in FIGS. 8 and 9, the indicating mechanism 130 includes the indicator 131 and a second spring 136 that urges the indicator 131. The indicator 131 includes a ring portion 132 into which the shaft 81B is inserted, a connecting piece 133 that projects toward the front wall 82 of the discharge tray 80 from the ring portion 132, the indicating portion 134 attached to an end of the connecting piece 133, and a receiving portion 135 that is formed integrally with the ring portion 132. The receiving portion 135 is an example of indicator contact portion. The second spring 136 is an example of an urging member.

When the second tray 70 is moved from the feeding position to the retracted position, the contact portion 74 on the pivoting portion 72 of the second tray 70 comes into contact with the receiving portion 135, so that the receiving portion 135 is pushed toward the front wall 82 of the discharge tray 80. When the receiving portion 135 is pushed by the second tray 70, the indicator 131 rotates around the shaft 81B so as to move from a first indicator position to a second indicator position. The second spring 136 urges the indicator 131 to move from the second indicator position to the first indicator position. Therefore, when the second tray 70 is moved from the retracted position to the feeding position, the indicator 131 moves from the second indicator position to the first indicator position by the urging force of the second spring 136.

The sliding portion 71 of the second tray 70 is locked at the front position by the above-described lock member 101. Therefore, the sliding portion 71 can be prevented from being pushed toward the back position by the indicator 131 that is urged by the second spring 136. The pivoting portion 72 has an inclined surface 74A which continues from the contact portion 74 and tapers toward the contact portion 74. When the discharge tray 80 is moved from the receiving position to the loading position while the second tray 70 is in a position other then the retracted position, the indictor 131 is in the first indicating position owing to the urging force applied by the second spring 136. Then, when the second tray 70 is moved to the retracted position and the discharge tray 80 is returned to the receiving position, the inclined surface 74A comes into contact with the receiving portion 135, so that the discharge tray 80 can be smoothly pivoted. Accordingly, the indicator 131 is moved to the second display position.

When the indicator 131 is rotated around the shaft 81B, the positions of a first indicating surface (not shown) and a second indicating surface (not shown) of the indicating portion 134 are changed. The first indicating surface shows information indicating that the second tray 70 is in the feeding position and the second sheets 54B are subjected to image recording. The second indicating surface shows information indicating that the second tray 70 is in the retracted position and the first sheets 54A are subjected to image recording.

The first indicating surface, whose position changes in response to the movement of the second tray 70, is exposed through the indication window 82A when the second tray 70 is in the feeding position (that is, when the indicator 131 is in the first indicating position), and is covered by the front wall 82 of the discharge tray 80 when the second tray 70 is in the retracted position (that is, when the indicator 131 is in the second indicating position). The second indicating surface is exposed through the display window 82A when the second tray 70 is in the retracted position, and is covered by the front wall 82 of the discharge tray 80 when the second tray 70 is in the feeding position. In the state in which the tray unit 50 is mounted in the printer housing 12, the user can recognize whether the first sheets 54A or the second sheets 54B are subjected to image recording from the information shown in the indicating surface that is visible through the indication window 82A.

In the present embodiment, the indication is switched by changing the positions of the first indicating surface and the second indicating surface, thereby to change the indicating surface that is visible through the display window 82A. Alternatively, the indication may be switched by changing the orientations of the first indicating surface and the second indicating surface. More specifically, both the first indicating surface and the second indicating surface may be exposed through the indication window 82A, and the orientations of the first indicating surface and the second indicating surface at the time when the second tray 70 is in the feeding position may be changed from those when the second tray 70 is in the retracted position. The user can recognize whether the first sheets 54A or the second sheets 54B are subjected to image recording from the information shown on the indicating surface that is oriented along the opening surface of the indication window 82A.

In addition, in the present embodiment, the indicating mechanism 130 switches the indication by changing the position of the indicator 131 in response to the sliding movement of the second tray 70. Alternatively, an indicating mechanism may be used which comprises a power source, a display unit, such as a light-emitting diode (LED), that is turned on when electric power is supplied from the power source, and a sensor, such as a tactile switch, that can be turned on or off in response to the sliding movement of the second tray 70. In such a case, the tactile switch is turned on or off in response to the sliding movement of the second tray 70, so that the LED is turned on or off accordingly. Thus, the indication is switched between the on state and the off state of the LED.

Figure 14B:
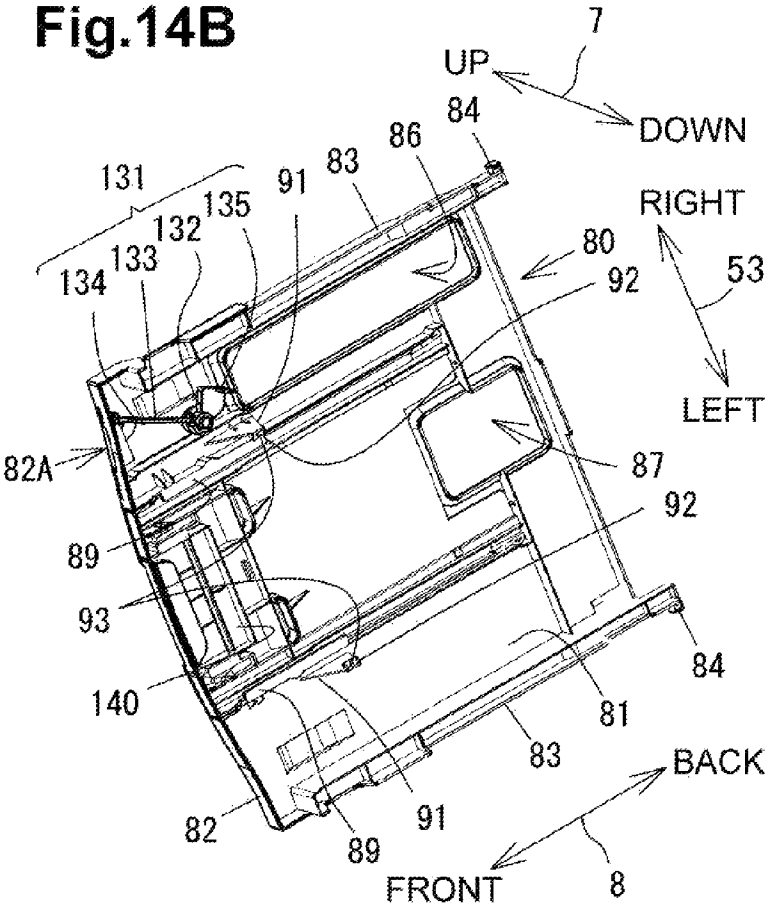
FIG. 14B is a perspective bottom view of the second tray located in the retracted position and overlapping with the discharged tray.
Figure 14A:
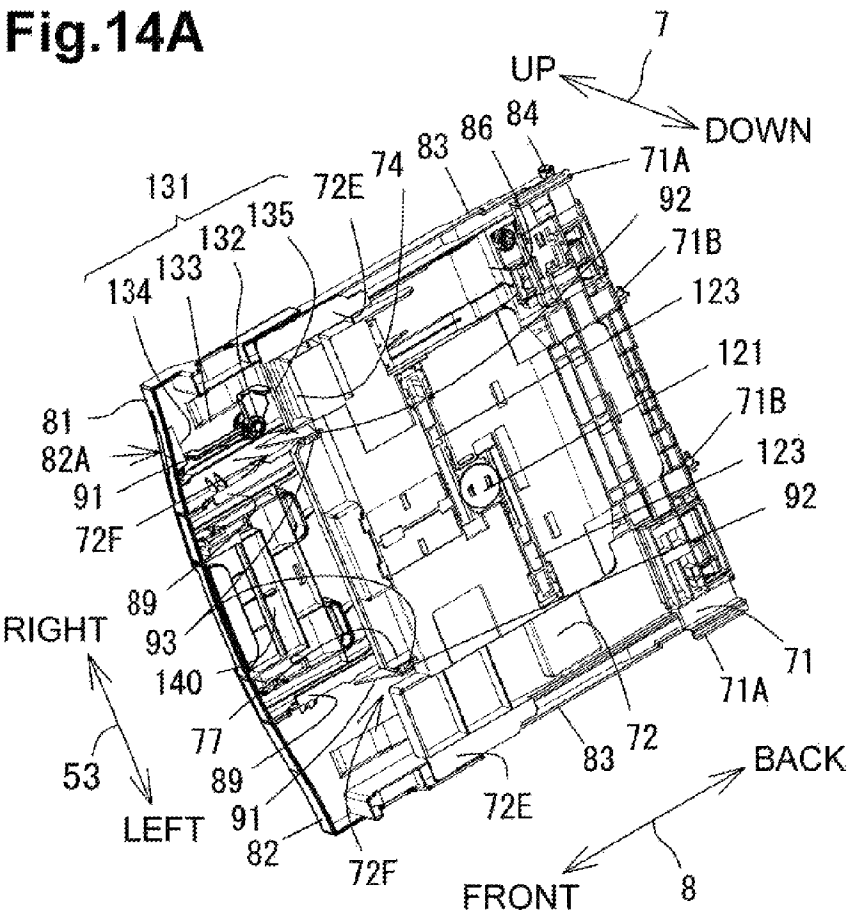
FIG. 14A is a perspective bottom view of the discharge tray, showing a surface opposite to a discharge sheet holding surface.

As shown in FIGS. 14A and 14B, the discharge tray 80 comprises left and right support ribs 89 that support an auxiliary tray 140 in a slidable manner. The support ribs 89 project from the lower surface of the base 81 at the side opposite to the discharged sheet holding surface 81A, and extend in the front-back direction 52 when the discharge tray 80 is in the receiving position. The support ribs 89 support left and right edges of the auxiliary tray 140, which has a rectangular shape, such that the auxiliary tray 140 is slidable in the front-back direction 52. The auxiliary tray 140 is an example of a third tray.

Figure 15:
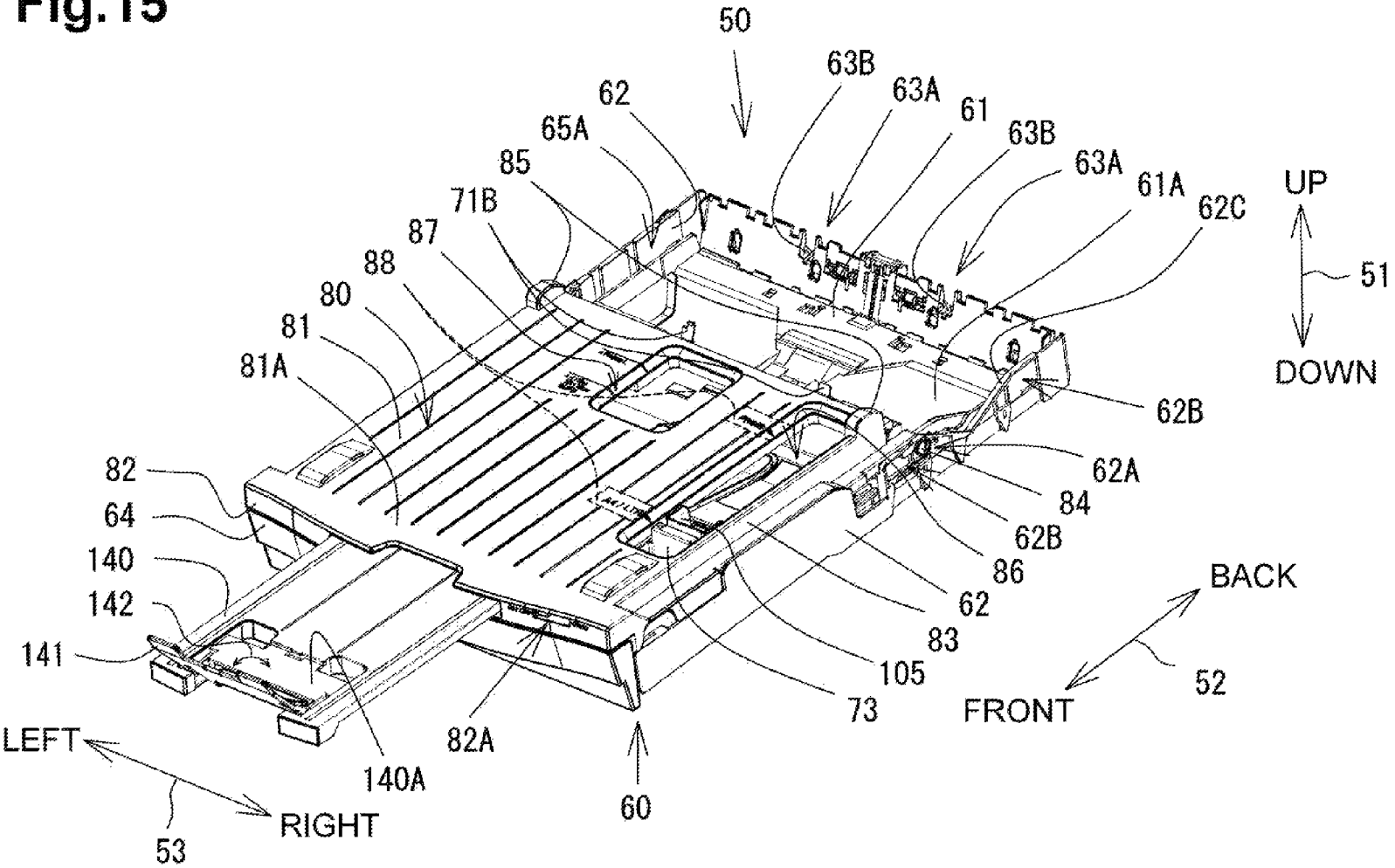
FIG. 15 is a perspective bottom view of the tray unit in which an auxiliary tray is extended.

The auxiliary tray 140 slides between a position stored in the discharge tray 80 shown in FIGS. 14A and 14B and a receiving position shown in FIG. 15. The auxiliary tray 140 receives, in cooperation with the discharge tray 80, the sheet 54 (see FIG. 2) having an image recorded thereon and discharged by the switchback rollers 34. As shown in FIG. 15, the auxiliary tray 140 has a recess 140A for housing therein a stopper 141. The recess 140A is located in the top surface of the auxiliary tray when the discharge tray 80 is in the receiving position. The recess 140A is located at the front end of the auxiliary tray 140 when the discharge tray 80 is in the receiving position.

The stopper 141 is supported by the auxiliary tray 140 such that the stopper 141 is pivotable in a pivoting direction 142 shown in FIG. 15. The stopper 141 pivots between the position in which the stopper 141 is housed in the recess 140A and a stopping position in which its pivoting end is positioned above the top surface of the auxiliary tray 140. When the stopper 141 is in the stopping position, a leading edge (that is, a front edge) of the sheet 54 having an image recorded thereon and ejected by the switchback rollers 34 comes into contact with the stopper 141. Accordingly, the sheet 54 is prevented from falling from the discharge tray 80 and the auxiliary tray 140.

Now, the operation for moving the second tray 70 of the tray unit 50 in the front-back direction 52 will be described. When the user grabs the release lever 105 and the operation lever 73, the lock member 101 is moved out of the lock hole 62B. When the user moves the release lever 105 and the operation lever 73 forward or backward while grabbing the release lever 105 and the operation lever 73, the second tray 70 is moved from the retracted position to the feeding position or from the feeding position to the retracted position. Then, when the user releases the release lever 105 after sliding the second tray 70, the lock member 101 is pushed rightward by the urging force of the first spring 71E and is moved from a retracted position to a projecting position. If the second tray 70 is in the feeding position or the refracted position, the lock member 101 is fitted into the corresponding lock hole 62B. The user determines whether or not the lock member 101 has been fitted to one of the lock holes 62B from a tactile sensation or a sound, and pulls or pushes the operation lever 73 if the lock member 101 has not been fitted to one of the lock holes 62B. The lock member 101 slides along the inner surface of the right side wall 62 of the main tray 60, and is fitted to one of the lock holes 62B when the second tray 70 reaches the feeding position or the retracted position.

When the second tray 70 is moved from the feeding position to the retracted position, the connecting pieces 91 enter the cut portions 72F in the second tray 70 and the engagement ribs 77 are placed between the base 81 and the hook pieces 92. When the second tray 70 is moved from the retracted position to the feeding position, the connecting pieces 91 leave the cut portions 72F in the second tray 70 and the engagement ribs 77 move out from between the base 81 and the hook pieces 92.

Next, the operation for opening the discharge tray 80 of the tray unit 50 from the receiving position while the second tray 70 is in the retracted position will be described.

In this state, as described above, the engagement ribs 77 on the pivoting portion 72 of the second tray 70 are placed between the base 81 and the hook pieces 92 of the discharge tray 80 in the up-down direction 51. However, the engagement ribs 77 are not in contact with or engaged with the hook pieces 92 of the base 81. Therefore, the second tray 70 moves smoothly, without being blocked by the hook pieces 92, from the feeding position to the retracted position. Then, when the discharge tray 80 is opened by the user, the engagement ribs 77 are caught by the hook pieces 92 from below. Since the sliding portion 71 is locked in the front position by the lock member 101, the pivoting portion 72 is pivoted, around the first support portion 71C provided on the sliding portion 71, together with the discharge tray 80. Thus, the loading port 65B of the main tray 60 is exposed when the user opens the discharge tray 80 and the pivoting portion 72 together. The user supplies the first sheets 54A to the main tray 60 through the loading port 65B in the exposed state. If the discharge tray 80 is opened while the second tray 70 is in the feeding position, only the discharge tray 80 is opened. In such a case, since the second tray 70 is in the feeding position, the loading port 65B of the main tray 60 is not covered by the second tray 70. Therefore, the loading port 65B is exposed by opening the discharge tray 80.

Next, the operation for opening the discharge tray 80 of the tray unit 50 from the receiving position while the second tray 70 is in the feeding position, and moving the second tray 70 from the feeding position to the refracted position, and then closing the discharge tray 80 will be described.

When the discharge tray 80 is closed, the inclined surfaces 93 of the hook pieces 92 come into contact with the projecting ends of the engagement ribs 77 provided on the pivoting portion 72 of the second tray 70. When the projecting ends come into contact with the inclined surfaces 93, the connecting pieces 91 are bent so as to allow the hook pieces 92 to move to below the engagement ribs 77, and then the connecting pieces 91 return to their original shapes. Thus, the discharge tray 80 is closed without causing any damage to the hook pieces 92 or the connecting pieces 91 even when the second tray 70 is in the retracted position.

In the present embodiment, the sheets 54 fed by the feed rollers 23 are switched between the first sheets 54A placed on the bottom 61 of the main tray 60 and the second sheets 54B placed on the pivoting portion 72 of the second tray 70 by moving the second tray 70 between the feeding position and the retracted position.

In the present embodiment where the discharge tray 80 is provided as a cover for covering a portion of the second tray 70 from above, the second tray 70 and the discharge tray 80 are configured to pivot together. Although, in the present embodiment, the discharge tray 80 is provided in the tray unit 50, a discharged sheet receiver that serves as the discharge tray 80 may be provided in the printer housing 12, and a cover may be provided in the tray unit 50 separately from the discharged sheet receiver.

Since the second tray 70 and the discharge tray 80 are separate components, the discharge tray 80 does not move as the second tray 70 slides. Accordingly, the discharge tray 80 can be placed above the second tray 70 at a position closer to the switchback rollers 34, and the discharged sheets 54 can be reliably received by the tray unit 50. In addition, since only the second tray is slidable, the discharge tray 80 can be disposed at a high position as desired without causing an interference with the recording unit 40. In particular, in a case where the return path 31B for achieving double-sided printing is provided in the image recording device 10 and a case where a mechanism or a substrate for achieving an additional function is disposed around the recording unit 40, it is necessary to position the recording unit 40 higher by an amount corresponding to the space occupied by the return path 31B, the mechanism, and the like. In such a case, if a discharged sheet receiving portion is formed integrally with a second tray, unlike the present embodiment, the vertical distance between the discharged sheet receiving portion and the discharge unit (switchback rollers 34) may increase and cause a sheet discharging failure due to curling or reversing of the discharged sheet.

In the present embodiment, from the state in which the second tray 70 is in the retracted position and the loading port 65B of the main tray 60 is covered by the pivoting portion 72 of the second tray 70 and the discharge tray 80, the pivoting portion 72 and the discharge tray 80 are pivoted together by the engagement between the hook pieces 92 of the discharge tray 80 and the engagement ribs 77 of the pivoting portion 72. Thus, the loading port 65B is opened and the first sheets 54*a* can be loaded into the main tray 60.

In the present embodiment, since the second tray 70 comprises the sliding portion 71 and the pivoting portion 72, the second tray 70 is slidable and pivotable. In addition, since the pivot axis of the pivoting portion 72 substantially coincides, in position, with the pivot axis of the discharge tray 80, the pivoting portion 72 and the discharge tray 80 can be pivoted together without causing a displacement between the pivoting portion 72 and the discharge tray 80. Thus, the user can open the discharge tray 80 integrally with the pivoting portion 72 of the second tray 70. Instead of the above-described structure, a pair of ribs may be formed on the inner surfaces of the side walls 62 of the main tray 60, and the second tray 70 may be supported on the ribs such that the second tray 70 is slidable and pivotable.

In addition, in the present embodiment, the sliding portion 71 of the second tray 70 is locked in the front position or the back position by fitting the lock member 101 to one of the lock holes 62B. In addition, the user can recognize that the sliding portion 71 of the second tray 70 has reached the front position or the back position from a tactile sensation or a sound generated when the lock member 101 is fitted to one of the lock holes 62B. However, the structure of the lock member 101 and the lock holes 62B is not limited to the above-described structure as long as the second tray 70 can be retained in the feeding position and the retracted position. Recesses or the like may be formed instead of the lock holes 62B.

In the present embodiment, the engagement ribs 77 are provided at a position relatively close to the pivoting end of the pivoting portion 72 of the second tray 70. Therefore, the operating force which must be applied by the user to open the pivoting portion 72 and the discharge tray 80 together can be reduced.

In addition, in the present embodiment, when only the discharge tray 80 is opened while the second tray 70 is in the feeding position and then the discharge tray 80 is closed after the second tray 70 is moved to the retracted position, the connecting pieces 91 are bent so as to allow the hook pieces 92 to move to below the engagement ribs 77. Thus, the discharge tray 80 can be closed without causing any damage to the hook pieces 92 or the connecting pieces 91.

In the present embodiment, the hook pieces 92, the connecting pieces 91, and the base 81 are formed integrally with each other by using synthetic resin material. Alternatively, a leaf spring which is fixed, at its one end, to the base 81 and, at its other end, to the hook piece 92 may be used as the connecting piece 91. Although, in the present embodiment, the hook piece 92 is positioned below the second tray 70 and is configured to catch the second tray 70 from below the second tray 70, the hook piece 92 may be configured differently as long as the second tray 70 can change its position in response to the positional change of the discharge tray 80. For example, the hook piece 92 may be disposed below the top surface of the second tray 70 and the engagement rib 77 may be formed at an intermediate position of the second tray 70 in the up-down direction 51 such that the engagement rib 77 is caught by the hook piece 92. In addition, the hook piece 92 may, of course, engage with the engagement rib 77 not only when the discharge tray 80 is moved from the receiving position to the loading position but also when the second tray 70 is moved to the refracted position.

Further, the connecting piece 91 may be formed by a leaf spring which is elastically deformable.

In another embodiment, the hook piece 92 may be supported by the base 81 such that the hook piece 92 is slidable in the left-right direction 53. In this case, the hook piece 92 is slidable between an engaging position to catch the engagement rib 77 of the pivoting portion 72 of the second tray 70 and a non-engaging position not to contact the engagement rib 77. The hook piece 92 is urged by a spring, such as a leaf spring or a coil spring, in a direction from the non-engaging position to the engaging position. When the discharge tray 80 is opened while the second tray 70 is in the feeding position and then the discharge tray 80 is closed after the second tray 70 is moved to the retracted position, the engagement rib 77 slides along an inclined surface, which is similar to the above-described inclined surface 93, on the hook piece 92 so that the hook piece 92 is moved from the engaging position to the non-engaging position. Thus, the hook piece 92 are moved to below the engagement rib 77.

In another embodiment, instead of the engagement rib 72 of the pivoting portion 72, an engagement member may be provided on the pivoting portion 72 such that the engagement member is slidable in the left-right direction 53. In this case, the engagement member is configured to slide between an engaging position to be caught by the hook piece 92 and a non-engaging position not to contact the hook piece 92. The engagement member is urged by a spring, such as a leaf spring or a coil spring, in a direction from the non-engaging position to the engaging position. When the discharge tray 80 is opened while the second tray 70 is in the feeding position and then the discharge tray 60 is closed after the second tray 70 is moved to the retracted position, the engagement member slides along an inclined surface, which is similar to the above-described inclined surface 93, on the hook piece 92 so that the engagement member is moved from the engaging position to the non-engaging position. Thus, the hook piece 92 is moved to below the engagement member.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. A tray unit comprising:

a first tray comprising a first holding surface for holding thereon a first sheet;

a second tray comprising a second holding surface for holding thereon a second sheet, wherein the second tray is configured to slide above and along the first holding surface between a first second-tray position and a second second-tray position, and configured to pivot between the second second-tray position and a third second-tray position in which the second tray stands upward with respect to the first holding surface; and a cover configured to cover from above at least a part of the second tray when the second tray is in the second second-tray position, and configured to pivot between a first cover position in which the cover extends along the first holding surface and a second cover position in which the cover stands upward with respect to the first holding surface, wherein a pivot axis of the second tray moves relative to a pivot axis of the cover as the second tray slides between the first second-tray position and the second second-tray position.

2. The tray unit according to claim 1, wherein the second tray comprises an engaged portion, and wherein the cover comprises an engaging portion configured to engage with the engaged portion of the second tray when the cover pivots from the first cover position to the second cover position.

3. The tray unit according to claim 2, wherein the engaging portion of the cover in the first cover position is disposed below the engaged portion of the second tray in the second second-tray position.

4. The tray unit according to claim 2, wherein the engaging portion of the cover in the first cover position is not in contact with the engaged portion of the second tray in the second second-tray position, and the engaging portion of the cover engages with the engaged portion of the second tray when the cover pivots from the first cover position to the second cover position.

5. The tray unit according to claim 2, wherein the engaging portion of the cover is disposed at a position closer to a pivoting end of the cover than to the pivot axis of the cover.

6. The tray unit according to claim 2, wherein when the cover pivots from the second cover position to the first cover position while the second tray is in the second second-tray position, at least one of the engaging portion and the engaged portion is configured to elastically deform upon contact of the engaging portion with the engaged portion, such that the engaging portion moves to below the engaged portion.

7. The tray unit according to claim 6, wherein the second tray comprises a cut portion formed in an upstream end thereof in a sliding direction of the second tray from the second second-tray position to the first second-tray position, and the engaging portion of the cover projects from the connecting member in a direction crossing the sliding direction of the second tray, and the connecting member is configured to enter the cut portion when the second tray slides from the first second-tray position to the second second-tray position.

8. The tray unit according to claim 2, wherein the cover comprises a base configured to extend along the first holding surface when the cover is in the first cover position, and a connecting member disposed at a position not interfering with sliding of the second tray and connecting the engaging portion to the base.

9. The tray unit according to claim 2, wherein at least one of the engaging portion of the cover and the engaged portion of the second tray comprises an inclined surface which is inclined with respect to a pivoting direction of the cover, and the other of the engaging portion and the engaged portion is configured to make slide contact with the inclined surface when the cover pivots from the second cover position to the first cover position while the second tray is in the second second-tray position.

10. The tray unit according to claim 1, wherein a pivot axis of the second tray in the second second-tray position coincides, in position, with the pivot axis of the cover.

11. The tray unit according to claim 1, wherein the first tray comprises a pair of side walls extending along a sliding direction of the second tray and opposed to each other in a direction parallel to the first holding surface and perpendicular to the sliding direction, and wherein the second tray comprises a sliding portion slidably supported by the pair of side walls, and a pivoting portion pivotably supported by the sliding portion.

12. The tray unit according to claim 1, wherein the first tray comprises two first positioning members spaced apart from each other in a sliding direction of the second tray, and wherein the second tray comprises a second positioning member configured to engage with one of the first positioning members when the second tray is in the first second-tray position, and with the other of the first positioning members when the second tray is in the second second-tray position.

13. The tray unit according to claim 12, wherein the first tray comprises a side wall standing upward from the first holding surface and extending along the sliding direction of the second tray, and each of the first positioning members has a recess formed in the side wall, wherein the second positioning member comprises a lock member configured to move between a projecting position and a retracted position relative to each of the recesses, and the second tray comprises an urging member configured to urge the lock member toward the projecting position.

14. The tray unit according to claim 1, further comprising an indicating mechanism configured to change indications depending on whether the second tray is in the first second-tray position or the second second-tray position.

15. The tray unit according to claim 14, wherein the indicating mechanism comprises an indicator comprising an indicator contact portion and configured to move from a first indicator position to a second indicator position when the second tray pushes the indicator contact portion.

16. The tray unit according to claim 15, wherein the cover pivotably supports the indicator, and the indicating mechanism comprises an urging member configured to urge the indicator from the second indictor position toward the first indicator position.

17. The tray unit according to claim 15, wherein the second tray comprises a second-tray contact portion disposed at an upstream end thereof in a sliding direction of the second tray from the second second-tray position to the first second-tray position and configured to contact the indicator contact portion when the second tray slides.

18. The tray unit according to claim 17, wherein the second-tray contact portion comprises an inclined surface which is inclined with respect to the sliding direction of the second tray and a pivoting direction of the cover.

19. The tray unit according to claim 17, wherein the second tray comprises a receiving portion disposed outside the second holding surface and configured to receive the cover when the cover pivots to the second cover position while the second tray is in the first second-tray position.

20. The tray unit according to claim 1, wherein the cover comprises a holdable portion configured to receive an external force for pivoting the cover.

21. The tray unit according to claim 1, wherein the cover comprises a cover portion configured to cover a side face of the second tray that intersects the second holding surface.

22. The tray unit according to claim 1, wherein the cover has an opening elongated in a sliding direction of the second tray, the second tray comprises an operation lever configured to be exposed through the opening, and the cover comprises a mark disposed adjacent to the opening and indicating information about at least one of a position of the second tray and types of the first and second sheets.

23. The tray unit according to claim 1, wherein the cover comprises a pivot shaft supported by the first tray.

24. The tray unit according to claim 1, wherein a pivoting end of the cover is received by the first tray.

25. An image recording device comprising:

a first tray comprising a first holding surface for holding thereon a first sheet;

a second tray comprising a second holding surface for holding thereon a second sheet, wherein the second tray is configured to slide above and along the first holding surface between a first second-tray position and a second second-tray position, and configured to pivot between the second second-tray position and a third second-tray position in which the second tray stands upward with respect to the first holding surface;

a cover configured to cover from above at least a part of the second tray when the second tray is in the second second-tray position, and configured to pivot between a first cover position and a second cover position, the cover comprising a pivot shaft supported by the first tray;

a feeder configured to feed the first sheet when the second tray is in the second second-tray position and to feed the second sheet when the second tray is in the first second-tray position;

a recording unit configured to record an image on the sheet fed by the feeder; and a discharging unit disposed above the cover and configured to discharge the sheet after the recording unit records the image on the sheet, wherein the cover comprises a plate portion configured to extend along the first holding surface of the first tray when the cover is in the first cover position and configured to stand upward with respect to the first holding surface when the cover is in the second cover position, and, when the cover is in the first cover position, a first surface of the plate portion is configured to receive the sheet discharged by the discharging unit and a second surface of the plate portion opposite to the first surface faces toward the first holding surface, and wherein the cover is configured to pivot between the first cover position and the second cover position independently from and relative to the second tray when the second tray is in the first second-tray position.

26. The image recording device according to claim 25, wherein the cover comprises a third tray configured to move between a receiving position in which the third tray cooperates with the first surface of the plate portion to receive the discharged sheet, and a stored position in which the third tray is stored in the cover, and wherein the third tray comprises a stopper configured to project in a direction crossing a direction in which the sheet is discharged by the discharging unit and to stop the discharged sheet.

27. The image recording device according to claim 25, further comprising a housing, wherein the first tray, the second tray, and the cover are configured to be mounted into and removed from the housing unitarily as a tray unit.

28. The image recording device according to claim 27, further comprising a convey path forming member disposed above the tray unit and configured to pivot between a guide position in which the convey path forming member defines a convey path for guiding the sheet, and an open position in which the convey path forming member opens the convey path, wherein the tray unit comprises a contact portion configured to push the convey path forming member from the open position to the guide position when the tray unit is mounted into the housing.

* * * * *